US011721355B2

(12) United States Patent
Eubank et al.

(10) Patent No.: US 11,721,355 B2
(45) Date of Patent: Aug. 8, 2023

(54) AUDIO BANDWIDTH REDUCTION

(71) Applicant: Apple Inc., Cupertino, CA (US)

(72) Inventors: Christopher T. Eubank, Mountain View, CA (US); Lance Jabr, Los Altos, CA (US); Matthew S. Connolly, San Jose, CA (US); Robert D. Silfvast, Belmont, CA (US); Sean A. Ramprashad, Los Altos, CA (US); Carlos Avendano, Campbell, CA (US); Miquel Espi Marques, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 17/677,850

(22) Filed: Feb. 22, 2022

(65) Prior Publication Data

US 2022/0180889 A1 Jun. 9, 2022

Related U.S. Application Data

(63) Continuation of application No. 16/940,792, filed on Jul. 28, 2020, now Pat. No. 11,295,754.
(Continued)

(51) Int. Cl.
*G10L 21/0388* (2013.01)
*G10L 21/0208* (2013.01)
(Continued)

(52) U.S. Cl.
CPC ..... *G10L 21/0388* (2013.01); *G10L 19/008* (2013.01); *G10L 21/0208* (2013.01); *G10L 21/0272* (2013.01)

(58) Field of Classification Search
CPC ..... G10L 21/0388; G10L 19/008; G10L 21/0208; G10L 21/0272; G10L 21/0216;
(Continued)

(56) References Cited

U.S. PATENT DOCUMENTS

2015/0179181 A1 6/2015 Morris et al.
2015/0332680 A1* 11/2015 Crockett ..... G10L 19/008 381/23
(Continued)

FOREIGN PATENT DOCUMENTS

CN 104717587 A 6/2015
CN 109147770 A 1/2019
CN 109416585 A 3/2019

OTHER PUBLICATIONS

First Search Document for Chinese Application No. 2020107449426 dated Jun. 29, 2021, 2 pages.
(Continued)

*Primary Examiner* — Yogeshkumar Patel
(74) *Attorney, Agent, or Firm* — Aikin & Gallant, LLP

(57) ABSTRACT

A first device obtains, from the array, several audio signals and processes the audio signals to produce a speech signal and one or more ambient signals. The first device processes the ambient signals to produce a sound-object sonic descriptor that has metadata describing a sound object within an acoustic environment. The first device transmits, over a communication data link, the speech signal and the descriptor to a second electronic device that is configured to spatially reproduce the sound object using the descriptor mixed with the speech signal, to produce several mixed signals to drive several speakers.

20 Claims, 7 Drawing Sheets

Related U.S. Application Data

(60) Provisional application No. 62/880,559, filed on Jul. 30, 2019.

(51) Int. Cl.
*G10L 19/008* (2013.01)
*G10L 21/0272* (2013.01)

(58) Field of Classification Search
CPC . G10L 2021/02166; H04R 5/02; H04R 3/005; H04S 7/304; H04S 3/008; H04S 7/305; H04S 2420/01; H04S 2420/03; H04S 2420/11; H04S 2400/01; H04S 2400/15
See application file for complete search history.

(56) References Cited

U.S. PATENT DOCUMENTS

| | | | | |
|---|---|---|---|---|
| 2016/0085305 | A1 | 3/2016 | Spio | |
| 2017/0195810 | A1 | 7/2017 | Gonzales, Jr. | |
| 2017/0357476 | A1* | 12/2017 | Dack | H04R 3/005 |
| 2018/0020312 | A1* | 1/2018 | Visser | H04S 7/302 |
| 2018/0278740 | A1* | 9/2018 | Choi | H04M 1/72403 |
| 2019/0028803 | A1* | 1/2019 | Benattar | H04R 5/0335 |
| 2021/0400413 | A1* | 12/2021 | Laaksonen | H04R 1/406 |

OTHER PUBLICATIONS

"UsdAudio Proposal", Pixar Animation Studios, document generated on Jun. 17, 2019, document accessible at: https://graphics.pixar.com/usd/docs/UsdAudio-Proposal.html, 3 pages.

First Office Action of the Chinese Patent Office dated Jul. 5, 2021 for related Chinese Patent Application No. 202010744942.6.

Florian et al., "Product Review—Dolby Surround Pro Logic II—The Technology and the Sound, Mar. 2001", Welcome Secrets of Home Theater and High Fidelity, vol. 8, Mar. 2001, Accessed on Feb. 18, 2019 at: https://hometheaterhifi.com/volume_8_1/dolby-prologic2-3-2001.html, 16 pages.

Non-Final Office Action of the U.S. Patent Office dated Sep. 9, 2021 for related U.S. Appl. No. 16/940,792.

Notice of Allowance of the U.S. Patent Office dated Nov. 24, 2021 for related U.S. Appl. No. 16/940,792.

Wallach, Hans, "The Role of Head Movements in Vestibular and Visual Cues in Sound Localization", Journal of Experimental Psychology, vol. 27, No. 4, Oct. 1940, pp. 339-368.

Second Office Action of the Chinese Patent Office dated Dec. 20, 2021 for related Chinese Patent Application No. 202010744942.6.

Third Office Action of the Chinese Patent Office dated Mar. 15, 2022 for related Chinese Patent Application No. 202010744942.6.

* cited by examiner

AUDIO BANDWIDTH REDUCTION

CROSS REFERENCE TO RELATED APPLICATION

This application is a continuation of pending U.S. application Ser. No. 16/940,792 filed Jul. 28, 2020, which claims the benefit of and priority to U.S. Provisional Patent Application No. 62/880,559 filed on Jul. 30, 2019, which are hereby incorporated by this reference in their entirety.

TECHNICAL FIELD

An aspect of the disclosure relates to an electronic device that performs bandwidth-reduction operations to reduce an amount of data to be transmitted to another electronic device over a computer network.

BACKGROUND

Headphones are an audio device that includes a pair of speakers, each of which is placed on top of a user's ear when the headphones are worn on or around the user's head. Similar to headphones, earphones (or in-ear headphones) are two separate audio devices, each having a speaker that is inserted into the user's ear. Headphones and earphones are normally wired to a separate playback device, such as a digital audio player, that drives each of the speakers of the devices with an audio signal in order to produce sound (e.g., music). Headphones and earphones provide a convenient method by which the user can individually listen to audio content without having to broadcast the audio content to others who are nearby.

SUMMARY

An aspect of the disclosure is a system that performs bandwidth-reduction operations to reduce an amount of audio data that is transmitted between two electronic devices (e.g., an audio source device and an audio receiver device) that are engaged in a communication session (e.g., a Voice Over IP (VoIP) phone call). For instance, both devices may engage in the session via a wireless communication data link (e.g., over a wireless network, such as a local area network (LAN)), whose bandwidth or available throughput may vary depending on several factors. For instance, the bandwidth may vary depending on how many other devices are wirelessly communicating over the wireless network and the distance between the source device and a wireless access point (or wireless router). The present disclosure provides a system for reducing an amount of bandwidth required to conduct a communication session by reducing an amount of audio data that is exchanged between both devices. The system includes an audio source device and an audio receiver device, both of which may be head-mounted devices (HMDs) that are communicating over a computer network (e.g., the Internet). The source device obtains several microphone audio signals that are captured by a microphone array of the device. The source device processes the audio signals to separate a speech signal (e.g., that contains speech of a user of the source device) from one or more ambient signals that contain ambient sound from an acoustic environment in which the source device is located. The source device processes the audio signals to produce a sound-object sonic descriptor that has metadata describing one or more sound objects within the acoustic environment, such as a dog bark or a helicopter flying in the air. The metadata may include an index identifier that uniquely identifies the sound object as a member or entry within a sound library that is previously known to the source device and/or the receiver device. The metadata may also include position data that indicates the position of the sound object (e.g., the dog bark is to the left of the source device) and loudness data that indicates a sound level of the sound object at the microphone array. The source device transmits the sonic descriptor, which has a reduced file size relative to audio data that may be associated with the sound object, and the speech signal to the audio receiver device. The receiver device uses the sonic descriptor to spatially reproduce the sound object, and mixes the reproduced sound object with the speech signal to produce several mixed signals to drive several speakers.

In one aspect, the system uses the metadata of the sonic descriptor to produce a reproduction of the sound object that includes an audio signal and position data that indicates a position of a virtual sound source of the sound object. For instance, the receiver device may use the index identifier to perform a table lookup into the sound library that has one or more entries of predefined sound objects, each entry having a corresponding unique identifier, using the unique identifier to identify a predefined sound object that has a matching unique identifier. Upon identifying the predefined sound object, the receiver device retrieves the sound object from the sound library that includes an audio signal that is stored within the sound library. The receiver device spatially renders the audio signal according to the position data to produce several binaural audio signals, which are mixed with the speech signal to drive the several speakers.

In one aspect, the system may produce other sonic descriptors that describe other types of sounds. For example, the system may produce a sound-bed sonic descriptor that describes an ambient or diffuse background noise or sound that is a part of a sound bed of the environment. As another example, the system may produce a phoneme sonic descriptor that includes phoneme data that may be a textual representation of the speech signal. Each of these sonic descriptors, including the sound-object sonic descriptors may have a reduced file size than corresponding audio signals that contain similar sounds. As a result, the system may transmit any number of combinations of the sonic descriptors in lieu of the actual audio signals based on the bandwidth or available throughput. For instance, if the bandwidth or available throughput is limited, the sound source device may transmit the phoneme sonic descriptor instead of the speech signal, which would otherwise require more bandwidth. The audio receiver device may synthesize a speech signal based on the phoneme sonic descriptor for output through at least one speaker, in lieu of the speech signal that is produced by the audio source device.

In one aspect, system may update or build a sound library, when an existing sound library does not include an entry that corresponds to an identified sound object. For instance, upon identifying a sound object within the acoustic environment, the audio source device may perform a table lookup into the existing sound library to determine whether the library includes a matching predefined sound object. If there is no matching predefined sound object, the source device may create an entry within the sound library, assigning metadata that is associated with the identified sound object to the entry. For example, the source device may create a unique identifier for the sound object. The source device may transmit the entry, which includes the sound object (e.g., audio data and/or metadata associated with the sound object) to the audio receiver device for storage in the receiver device's local library. As a result, the next time the sound object is identified by the source device, rather than transmitting the sound object, the source device may transmit the sound object sonic descriptor that includes the unique index identifier. In turn, the receiver device may retrieve the corresponding sound object for spatial rendering through two or more speakers, as described herein.

The above summary does not include an exhaustive list of all aspects of the present disclosure. It is contemplated that the disclosure includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The aspects of the disclosure are illustrated by way of example and not by way of limitation in the figures of the accompanying drawings in which like references indicate similar elements. It should be noted that references to "an" or "one" aspect of the disclosure are not necessarily to the same aspect, and they mean at least one. Also, in the interest of conciseness and reducing the total number of figures, a given figure may be used to illustrate the features of more than one aspect of the disclosure, and not all elements in the figure may be required for a given aspect.

DETAILED DESCRIPTION

Figure 1:
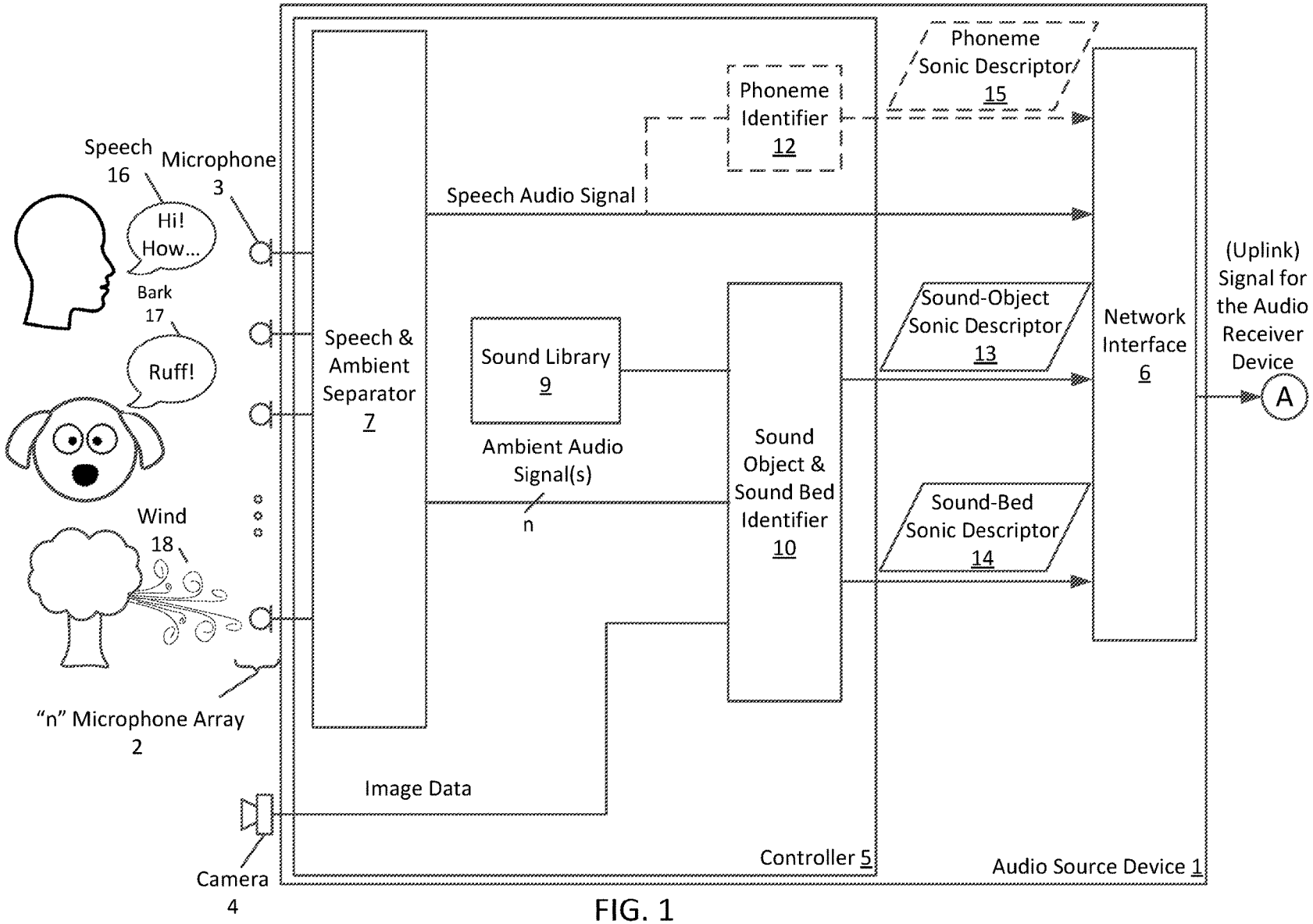
FIG. 1 shows a block diagram of an audio source device according to one aspect of the disclosure

Several aspects of the disclosure with reference to the appended drawings are now explained. Whenever the shapes, relative positions, and other aspects of the parts described in the aspects are not explicitly defined, the scope of the disclosure is not limited only to the parts shown, which are meant merely for the purpose of illustration. Also, while numerous details are set forth, it is understood that some aspects of the disclosure may be practiced without these details. In other instances, well-known circuits, structures, and techniques have not been shown in detail so as not to obscure the understanding of this description. In one aspect, ranges disclosed herein may include any value (or quantity) between end point values and/or the end point values.

A physical environment (or setting) refers to a physical world that people can sense and/or interact with without aid of electronic systems. Physical environments, such as a physical park, include physical articles, such as physical trees, physical buildings, and physical people. People can directly sense and/or interact with the physical environment, such as through sight, touch, hearing, taste, and smell.

In contrast, a computer-generated reality (CGR) environment (setting) refers to a wholly or partially simulated environment that people sense and/or interact with via an electronic system. In CGR, a subset of a person's physical motions, or representations thereof, are tracked, and, in response, one or more characteristics of one or more virtual objects simulated in the CGR environment are adjusted in a manner that comports with at least one law of physics. For example, a CGR system may detect a person's head turning and, in response, adjust graphical content and an acoustic field presented to the person in a manner similar to how such views and sounds would change in a physical environment. In some situations (e.g., for accessibility reasons), adjustments to characteristic(s) of virtual object(s) in a CGR environment may be made in response to representations of physical motions (e.g., vocal commands).

A person may sense and/or interact with a CGR object using any one of their senses, including sight, sound, touch, taste, and smell. For example, a person may sense and/or interact with audio objects that create 3D or spatial audio environment that provides the perception of point audio sources in 3D space. In another example, audio objects may enable audio transparency, which selectively incorporates ambient sounds from the physical environment with or without computer-generated audio. In some CGR environments, a person may sense and/or interact only with audio objects.

Examples of CGR include virtual reality and mixed reality. A virtual reality (VR) environment refers to a simulated environment that is designed to be based entirely on computer-generated sensory inputs for one or more senses. A VR environment comprises a plurality of virtual objects with which a person may sense and/or interact. For example, computer-generated imagery of trees, buildings, and avatars representing people are examples of virtual objects. A person may sense and/or interact with virtual objects in the VR environment through a simulation of the person's presence within the computer-generated environment, and/or through a simulation of a subset of the person's physical movements within the computer-generated environment.

In contrast to a VR environment, which is designed to be based entirely on computer-generated sensory inputs, a mixed reality (MR) environment refers to a simulated environment that is designed to incorporate sensory inputs from the physical environment, or a representation thereof, in addition to including computer-generated sensory inputs (e.g., virtual objects). On a virtuality continuum, a mixed reality environment is anywhere between, but not including, a wholly physical environment at one end and virtual reality environment at the other end.

In some MR environments, computer-generated sensory inputs may respond to changes in sensory inputs from the physical environment. Also, some electronic systems for presenting an MR environment may track location and/or orientation with respect to the physical environment to enable virtual objects to interact with real objects (that is, physical articles from the physical environment or representations thereof). For example, a system may account for movements so that a virtual tree appears stationery with respect to the physical ground.

Examples of mixed realities include augmented reality and augmented virtuality. An augmented reality (AR) environment refers to a simulated environment in which one or more virtual objects are superimposed over a physical environment, or a representation thereof. For example, an electronic system for presenting an AR environment may have a transparent or translucent display through which a person may directly view the physical environment. The system may be configured to present virtual objects on the transparent or translucent display, so that a person, using the system, perceives the virtual objects superimposed over the physical environment. Alternatively, a system may have an opaque display and one or more imaging sensors that capture images or video of the physical environment, which are representations of the physical environment. The system composites the images or video with virtual objects, and presents the composition on the opaque display. A person, using the system, indirectly views the physical environment by way of the images or video of the physical environment, and perceives the virtual objects superimposed over the physical environment. As used herein, a video of the physical environment shown on an opaque display is called "pass-through video," meaning a system uses one or more image sensor(s) to capture images of the physical environment, and uses those images in presenting the AR environment on the opaque display. Further alternatively, a system may have a projection system that projects virtual objects into the physical environment, for example, as a hologram or on a physical surface, so that a person, using the system, perceives the virtual objects superimposed over the physical environment.

An augmented reality environment also refers to a simulated environment in which a representation of a physical environment is transformed by computer-generated sensory information. For example, in providing pass-through video, a system may transform one or more sensor images to impose a select perspective (e.g., viewpoint) different than the perspective captured by the imaging sensors. As another example, a representation of a physical environment may be transformed by graphically modifying (e.g., enlarging) portions thereof, such that the modified portion may be representative but not photorealistic versions of the originally captured images. As a further example, a representation of a physical environment may be transformed by graphically eliminating or obfuscating portions thereof.

An augmented virtuality (AV) environment refers to a simulated environment in which a virtual or computer generated environment incorporates one or more sensory inputs from the physical environment. The sensory inputs may be representations of one or more characteristics of the physical environment. For example, an AV park may have virtual trees and virtual buildings, but people with faces photorealistically reproduced from images taken of physical people. As another example, a virtual object may adopt a shape or color of a physical article imaged by one or more imaging sensors. As a further example, a virtual object may adopt shadows consistent with the position of the sun in the physical environment.

There are many different types of electronic systems that enable a person to sense and/or interact with various CGR environments. Examples include head mounted systems (or head mounted devices (HMDs)), projection-based systems, heads-up displays (HUDs), vehicle windshields having integrated display capability, windows having integrated display capability, displays formed as lenses designed to be placed on a person's eyes (e.g., similar to contact lenses), headphones/earphones, speaker arrays, input systems (e.g., wearable or handheld controllers with or without haptic feedback), smartphones, tablets, and desktop/laptop computers. A head mounted system may have one or more speaker(s) and an integrated opaque display. Alternatively, a head mounted system may be configured to accept an external opaque display (e.g., a smartphone). The head mounted system may incorporate one or more imaging sensors to capture images or video of the physical environment, and/or one or more microphones to capture audio of the physical environment. Rather than an opaque display, a head mounted system may have a transparent or translucent display. The transparent or translucent display may have a medium through which light representative of images is directed to a person's eyes. The display may utilize digital light projection, OLEDs, LEDs, uLEDs, liquid crystal on silicon, laser scanning light source, or any combination of these technologies. The medium may be an optical waveguide, a hologram medium, an optical combiner, an optical reflector, or any combination thereof. In one embodiment, the transparent or translucent display may be configured to become opaque selectively. Projection-based systems may employ retinal projection technology that projects graphical images onto a person's retina. Projection systems also may be configured to project virtual objects into the physical environment, for example, as a hologram or on a physical surface.

With the proliferation of electronic devices in homes and businesses that are interconnected with each other over the Internet (such as in an Internet of Things (IoT) system), the speed and rate of data transmission (or data transfer rate) over the Internet (e.g., to a remote server) via a computer network (e.g., a Local Area Network (LAN)) becomes an important issue. For instance, electronic devices that are on one LAN may each share the same internet connection via an access point, such as a cable modem that exchanges data (e.g., transmits and receives Internet Protocol (IP) packets) with other remote devices via an internet service provider (ISP). The internet connection with the ISP may have a limited Internet bandwidth based on several factors, such as the type of cable modem that is being used. For instance, different cable modems may support different connection speeds (e.g., over 150 Mbps) depending on which Data Over Cable Service Interface Specification (or DOCSIS) standard is supported by the cable modem.

Bandwidth is also an issue with wireless electronic devices that communicate with each other over a wireless local area network (WLAN), such as multimedia gaming systems, security devices, and portable personal devices (e.g., smart phones, computer tablets, laptops, etc.). For instance, along with having a shared limited Internet bandwidth (when these devices communicate with other devices over the Internet), the wireless electronic devices may share a wireless bandwidth, which is the rate of data transmission between a wireless router and devices within the WLAN. This bandwidth may vary between devices based on several additional factors, such as the type of IEEE 802.11x standard supported by the wireless router that is supplying the WLAN and the distance between the wireless electronic devices and the wireless router. Since the number of wireless electronic devices that are in homes and businesses are increasing, each vying for a portion of the available wireless bandwidth (and/or Internet bandwidth), the bandwidth requirement for these devices may exceed the availability. In this case, each device may be allocated a smaller portion of available bandwidth resulting in a slower data-transfer rate.

Applications executing on electronic devices that rely on close-to-real-time data transmission may be most affected by a slower data rate (or slower throughput). For instance, applications that cause the electronic device to engage in a communication session (e.g., a Voice of Internet Protocol (VoIP) phone call) may require a certain amount of bandwidth (or throughput). For example, to engage in a communication session, the electronic device (e.g., source device) may capture audio data (e.g., using a microphone integrated therein) and (e.g., wirelessly) transmit the audio data to another electronic device (e.g., receiving device) as an uplink. In order to preserve a real-time user experience on the receiving device, a certain minimum threshold of bandwidth may be necessary. As another example, both devices may engage in a video conference in which both devices transmit audio/video data in real time. When bandwidth is exceeded, the electronic device may adjust application settings (e.g., sound quality, video quality, etc.) in order to reduce the amount of bandwidth required to conduct the video conference. In some cases, however, the adjustment may be insufficient and the application may be forced to terminate data transmission entirely (e.g., by ending the phone call or video conference).

As another example, an electronic (e.g., a wireless earphone) may experience bandwidth or throughput issues while communicatively coupled or paired with media playback device (e.g., smart phone) that is engaged in a communication session. For instance, a user may participate in a handsfree phone call that is initiated by a media playback device, but conducted through the wireless earphone. In this case, the wireless earphone may establish a communication link, via a wireless personal area network (WPAN) using any wireless protocol, such as BLUETOOTH protocol. During the phone call, the throughput of data packets may reduce (e.g., based on the distance between the wireless earphone and the media playback device). As a result, the media playback device may drop the phone call. Therefore, there is a need for a reduction in the bandwidth (or throughput) requirement for applications that transmit audio data to other devices.

To accomplish this, the present disclosure describes an electronic device (e.g., an audio source device) that is capable of performing bandwidth-reduction operations to reduce the amount of (e.g., audio) data to be transmitted to another electronic device (e.g., an audio receiver device) via a communication data link. Specifically, the audio source device is configured to obtain several audio signals produced by an array of microphones and process the audio signals to produce a speech signal and a set of ambient signals. The device processes the set of ambient signals to produce a plurality of sound-object sonic descriptors that have metadata that describe sound objects or sound assets (e.g., a sound within the ambient environment in which the device is located, such as a car honk) within the ambient signals. For instance, the metadata may include an index identifier that uniquely identifies the sound object, as well as other information (or data) regarding the sound object, such as its position with respect to the source device. In one aspect, the sound-object sonic descriptor may have a lower file size than the ambient signals. Rather than transmit the speech signal and the ambient signals, the device transmits the speech signal and the sound-object sonic descriptor, which may have a significantly lower file size than the ambient signals to an audio receiver device. The receiver device then is configured to use the sound-object sonic descriptor to spatially reproduce sound object with the speech signal, to produce several mixed signals to drive speakers. Thus, instead of transmitting the ambient signals or the sound object (which may include an audio signal), the audio source device may reduce the bandwidth requirement (or necessary throughput) for transmitting the audio data to the audio receiver device by transmitting the sound-object sonic descriptor instead of at least one of the ambient signals.

In one aspect, "bandwidth" may correspond to an amount of data that can be sent from the audio source device to the audio receiver device in a certain period of time. In another aspect, as described herein, bandwidth or available throughput may correspond to a data rate (or throughput) that is necessary for a source device to transmit audio data to a receiver device in order for the receiver device to render and output the audio data at a given level of audio quality. This data rate, however, may exceed bandwidth that is available at either a source device and/or a receiver device. Thus, as described herein, in order to maintain audio quality, the source device may adjust an amount of audio data for transmission based on the bandwidth or available throughput at either side. More about this process is described herein.

As used herein, a "sound object" may refer to a sound that is captured by at least one microphone of an electronic device within an acoustic environment in which the electronic device is located. The sound object may include audio data (or an audio signal) that contains the sound and/or metadata that describes the sound. For instance, the metadata may include position data of the sound within the acoustic environment, with respect to the electronic device and other data that describes the sound (e.g., loudness data, etc.) In one aspect, the metadata may include a physical description of the sound object (e.g., size, shape, color, etc.).

FIG. 1 shows a block diagram illustrating an audio source device 1 for performing audio data bandwidth reduction operations according to one aspect of the disclosure. In one aspect, the audio source device 1 may be any electronic device that is capable of capturing, using at least one microphone, the sound of an ambient acoustic environment as audio data (or one or more audio signals), and (wirelessly) transmitting a sonic descriptor (e.g., a data structure) that includes metadata describing the audio data to another electronic device. Examples of such devices may include a headset, a head-mounted device (HMD), such as smart glasses, or a wearable device (e.g., a smart watch, headband, etc.). Other examples of such devices may include headphones, such as in-ear (e.g., wireless earphones or earbuds), on-ear, or over-the-ear headphones. Thus, "headphones" may include a pair of headphones (e.g., with two earcups) or at least one earphone (or earbud).

As described herein, the device 1 may be a wireless electronic device that is configured to establish a wireless communication data link via a network interface 6 with another electronic device, over a wireless computer network (e.g., a wireless personal area network (WPAN)) using e.g., BLUETOOTH protocol or a WLAN in order to exchange data. In one aspect, the network interface 6 is configured to establish a wireless communication link with a wireless access point in order to exchange data with a remote electronic server (e.g., over the Internet). In another aspect, the network interface 6 may be configured to establish a communication link via a mobile voice/data network that employs any type of wireless telecom protocol (e.g., a 4G Long Term Evolution (LTE) network).

In one aspect, the audio source device 1 may be a part of a computer system that includes a separate (e.g., companion) device, such as a smart phone or laptop, with which the source device 1 establishes a (e.g., wired and/or wireless) connection in order to pair both devices together. In one aspect, the (e.g., programmed processor of the) companion device may perform one or more of the operations described herein, such as bandwidth reduction operations. For instance, the companion device may obtain microphone signals from the source device 1, and perform the reduction operations, as described herein. In another aspect, at least some of the elements of the source device 1 may be a part of the companion device (or another electronic device) within the system. More about the elements of the source device 1 is described herein.

The audio source device 1 includes a microphone array 2 that has "n" number of microphones 3, one or more cameras 4, a controller 5, and the network interface 6. Each microphone 3 may be any type of microphone (e.g., a differential pressure gradient micro-electromechanical system (MEMS) microphone) that is configured to convert acoustic energy caused by sound waves propagating in the acoustic (e.g., physical) environment into an audio (or microphone) signal. The camera 4 is configured to capture image data (e.g., digital images) and/or video data (which may be represented as a series of digital images) that represents a scene of the physical environment in the field of view of the camera 4. In one aspect, the camera 4 is a Complementary Metal-Oxide-Semiconductor (CMOS) image sensor. In another aspect, the camera may be a Charged-Coupled Device (CCD) camera type. In some aspects, the camera may be any type of digital camera.

The controller 5 may be a special-purpose processor such as an Application-Specific Integrated Circuit (ASIC), a general purpose microprocessor, a Field-Programmable Gate Array (FPGA), a digital signal controller, or a set of hardware logic structures (e.g., filters, arithmetic logic units, and dedicated state machines). The controller 5 is configured to perform audio data bandwidth-reduction operations, as described herein. In one aspect, the controller 5 may perform other operations, such as audio/image processing operations, networking operations, and/or rendering operations. More about how the controller 5 may perform these operations is described herein.

In one aspect, the audio source device may include more or less components as described herein. For instance, the audio source device 1 may include more or less microphones 3 and/or cameras 4. As another example, the audio source device 1 may include other components, such as one or more speakers and/or one or more display screens. More about these other components is described herein.

The controller 5 includes a speech & ambient separator 7, a sound library 9, and a sound object & sound bed identifier 10. In one aspect, the controller may optionally include a phoneme identifier 12. More about this operational block is described herein. In one aspect, although illustrated as being separate, (a portion of) the network interface 6 may be a part of the controller 5.

The process in which the audio source device 1 may perform audio bandwidth-reduction operations, while transmitting audio data to an audio receiver device 20 for presentation will now be described. The audio device 1 captures, using one or more n microphones 3 of the microphone array 2 sounds from within the acoustic environment as one or more (microphone) audio signals. Specifically, the audio signals include speech 16 that is spoken by a person (e.g., a user of the device 1) and other ambient sounds, such as a dog barking 17 and wind noise 18 (which may include leaves rustling). The speech & ambient separator 7 is configured to obtain (or receive) the at least some of the audio (or microphone) signals produced by the n microphones and to process the audio signals to separate the speech 16 from the ambient sounds (e.g., 17 and 18). Specifically, the separator produces a speech signal (or audio signal) that contains mostly (or only) the speech 13 captured by the microphones of the array 2. The separator also produces one or more (or a set of) ambient signals that include mostly (or only) the ambient sound(s) from within the acoustic environment in which the source device 1 is located. In one aspect, the each of the "n" number of ambient signals corresponds to a particular microphone 3 in the array 2. In another aspect, the set of ambient signals may be more (or less) than a number of audio signals produced by each of the microphones 3 in the array 2. In some aspects, the separator 7 separates the speech by performing a speech (or voice) detection algorithm upon the microphone signals to detect the speech 16. The separator 7 may then produce a speech signal according to the detected speech. In one aspect, the separator 7 may perform noise suppression operations on one or more of the audio signals to produce the speech signal (which may be one audio signal from one microphone or a mix of multiple audio signals. The separator 7 may produce the ambient signals by suppressing the speech contained in at least some of the microphone signals. In one aspect, the separator 7 may perform noise suppression operations upon the microphone signals in order to improve Signal-to-Noise Ratio (SNR). For instance, the separator 7 may spectrally shape at least some of the signals (e.g., the speech signal) to reduce noise. In one aspect, the separator 7 may perform any method to separate the speech signal from the audio signals and/or to suppress the speech in the audio signals to produce the ambient signals. In one aspect, the ambient signals may include at least some speech (e.g., from a different talker, than the user of the device 1).

The sound object & sound bed identifier 10 is configured to identify a sound object contained within (e.g., the ambient signals containing) the acoustic environment and/or identify an ambient or diffuse background sound as (at least part of) a sound bed of the acoustic environment. As described herein, a sound object is a particular sound that is captured by the microphone array 2, such as the dog bark 17. In one aspect, a sound object is a sound that may occur aperiodically within the environment. In another aspect, a sound object is a particular or specific sound produced by a sound source (or object) within the environment. An example of a sound object may be the dog bark 17, which may be made by a particular breed of dog as the sound source. A sound that is a part of a sound bed, however, may be an ambient or diffuse background sound or noise that may occur continuously or may be reoccurring sound(s) that are associated with a particular environment. An example may be the sound of a refrigerator's condenser that periodically turns on and off. In one aspect, ambient background noise that is diffuse within the environment, and thus does not have a particular sound source may be a part of the sound bed, such as the wind noise 18. In another aspect, general ambient sounds (e.g., sounds that may sound the same at multiple locations) may be a part of the sound bed. Specifically, sounds that contain audio content that is indistinguishable from other similar sounds may be associated with the sound bed. For example, as opposed to a dog bark, which may change between breeds of dogs, the sound of wind noise 18 may be the same (e.g., the spectral content of different wind noise may be similar to one another), regardless of location. In one aspect, sound objects may be associated or a part of the sound bed.

The sound object & sound bed identifier 10 identifies sound objects and sound beds as follows. The identifier is configured to obtain and process at least one of the set of ambient signals to 1) identify a sound source (e.g., a position of the sound source within the acoustic environment) in at least one of the ambient signals and 2) produce spatial sound-source data that spatially represents the sound of the sound source (e.g., having data that indicates the position of the sound source with respect to the device 1). For instance, the spatial sound-source data may be an angular/parametric representation of the sound source with respect to the audio source device 1. Specifically, the sound-source data indicates a three-dimensional (3D) position of the sound source with respect to the device (e.g., located on a virtual sphere surrounding the device) as position data (e.g., elevation, azimuth, distance, etc.). In one aspect, any method may be performed to produce the angular/parametric representation of the sound source, such as a Higher Order Ambisonics (HOA) representation of the sound source by encoding the sound source into HOA B-Format by panning and/or upmixing the at least one of ambient signals. In another aspect, the spatial sound-source data may include an audio data (or an audio signal) of the sound and metadata associated with the sound (e.g., position data). For example, the audio data may be digital audio data (e.g., pulse-code modulation (PCM) digital audio information, etc.) of sound that is projected from an identified sound source. Thus, in some aspects, the spatial sound-source data may include position data of the sound source (e.g., as metadata) and/or audio data associated with the sound source. As an example, spatial sound-source data of the dog bark 17 may include an audio signal that contains the bark 17 and position data of the source (e.g., the dog's mouth) of the bark 17, such as azimuth and elevation with respect to the device 1 and/or distance between the source and the device 1. In one aspect and as described herein, the identified sound source may be associated with a sound object, which may be identified using the spatial sound-source data.

In one aspect, the identifier 10 may include a sound pickup microphone beamformer that is configured to process the ambient audio signals (or the microphone signals) to form at least one directional beam pattern in a particular direction, so as to be more sensitive to a sound source in the environment. In one aspect, the identifier 10 may use position data of the sound source to direct a beam pattern towards the source. In one aspect, the beamformer may use any method to produce a beam pattern, such as time delay of arrival and delay and sum beamforming to apply beamforming weights (or weight vectors) upon the audio signals to produce at least one sound pickup output beamformer signal that includes the directional beam pattern aimed towards the sound source. Thus, the spatial sound source data may include at least one sound pickup output beamformer signal that includes the produced beam pattern that includes at least one sound source. More about using beamformers is described herein.

The sound library 9 may be a table (e.g., in a data structure that is stored in local memory) having an entry for one or more (e.g., predefined) sound objects. Each entry may include metadata that describes the sound object of a corresponding entry. For instance, the metadata may include a unique index identifier (e.g., a text identifier) that is associated with a sound object, such as the dog bark 17. In addition, the metadata of an entry may include descriptive data that describes (or includes) physical characteristics of a sound object (or of the source of the sound object). For instance, returning to the previous example, when the sound source is a dog and the sound object is the bark 17, the descriptive data may include the type (or breed) of dog, the color of the dog, the shape/size of the dog, the position of the dog (with respect to the device 1), and any other physical characteristics of the dog. In some aspects, the metadata may include position data, such as global positioning system coordinates or position data that is relative to the audio source device 1, for example azimuth, elevation, distance, etc. In one aspect, the metadata may include sound characteristics of the sound object, such as (at least a portion of) audio data containing the sound object (e.g., PCM digital audio, etc.), samples of spectral content of the sound object, loudness data (e.g., a sound pressure level (SPL) measurement, a loudness, K-weighted, relative to full scale (LKFS) measurement, etc.), and other sound characteristics such as tone, timbre, etc. Thus, with respect to dog barks, the library 9 may include a dog bark entry for each type of dog. In some aspects, some entries may include more (or less) metadata than other entries in the library 9.

In one aspect, at least some of the entries may be predefined in a controlled setting (e.g., produced in a laboratory and stored in memory of the device 1). As described herein, at least some of the entries may be created by the audio source device 1 (or another device, such as the audio receiver device 20). For example, if it is determined that a sound object is not contained within the sound library 9, an entry for the sound object may be created by the identifier 10 and stored within the library 9. More about creating entries in the library 9 is described herein.

The sound object & sound bed identifier 10 is configured to use (or process) the spatial sound-source data to identify the source's associated sound object. In one aspect, the identifier 10 may use a sound identification algorithm to identify the sound object. Continuing with the previous example, to identify the bark 17, the identifier 10 may analyze the audio data within the spatial sound-source data to identify one or more sound characteristics of the audio data (e.g., spectral content, etc.) that is associated with a bark, or more particularly with the specific bark 17 (e.g., from that specific breed of dog). In another aspect, the identifier 10 may perform a table lookup into the sound library 9 using the spatial sound-source data to identify the sound object as a matching sound object (or entry) contained therein. Specifically, the identifier 10 may perform the table lookup to compare the spatial sound-source data (e.g., the audio data and/or metadata) with at least some of the (e.g., metadata of the) entries contained within the library 9. For instance, the identifier 10 may compare the audio data and/or position data of the spatial sound-source data with stored audio data and/or stored position data of each sound object of the library 9. Thus, the identifier 10 identifies a matching predefined sound object within the library 9, when the audio data and/or position data of the sound-source data matches at least some of the sound characteristics of a sound object (or entry) within the library 9. In one aspect, to identify a sound object, the identifier 10 can match the spatial sound-source data to at least some of the stored metadata up to a tolerance (e.g., 5%, 10%, 15%, etc.). In other words, a matching predefined sound object in the library 9 does not necessarily need to be an exact match.

In one aspect, in addition to (or in lieu) of using sound characteristics (or metadata) of the spatial sound-source data to identify the sound object, the identifier 10 may use image data captured by the camera 4 to (help) identify the sound object within the environment. The identifier 10 may perform an object recognition algorithm upon the image data to identify an object within the field of view of the camera. For instance, the algorithm may determine (or identify) descriptive data that describes physical characteristics of an object, such as shape, size, color, movement, etc. The identifier 10 may perform the table lookup into the sound library 9 using the determined descriptive data to identify the sound object with (at least partially) matching descriptive data. For instance, the identifier 10 may compare physical characteristics of an object (such as hair color of a dog) with the hair color of at least some of the entries in the sound library that relate to dogs. In another aspect, the identifier 10 may perform a separate table lookup into a data structure that associates descriptive data with predefined objects. Once matching physical characteristics are found (which may be within a tolerance threshold), the identifier 10 identifies an object within the field of view of the camera as at least one of the predefined objects.

In one aspect, the identifier 10 is configured to use (or process) the spatial sound-source data to identify the sound (or sound object) associated with the source data as (a part of) a sound bed of the acoustic environment. In one aspect, a sound object that is determined to be an ambient or diffuse background noise sound is determined by the identifier 10 to be a part of the sound bed of the environment. In one aspect, the identifier 10 may perform similar operations as those performed to identify the source's associated sound object. In one aspect, upon identifying a matching entry in the sound library, the metadata of the entry may indicate that the sound is a part of the sound bed. In another aspect, the identifier may determine that a sound (object) associated with the spatial sound-source data is a part of the sound bed based on a determination that the sound occurs at least two times within a threshold period of time (e.g., ten seconds), indicating that the sound is an ambient background sound. In another aspect, the identifier 10 may determine a sound to be a part of the sound bed if the sound is continuous (e.g., constant, such as being above a sound level, for a period of time, such as ten seconds). In another aspect, the identifier 10 may determine that a sound of the spatial sound-source data is a part of the sound bed based on the diffusiveness of the sound. As another example, the identifier 10 may determine whether a sound is similar to multiple (e.g., more than one) entries within the library 9, indicating that the sound is more generic and therefore may be a part of the sound bed.

Figure 2:
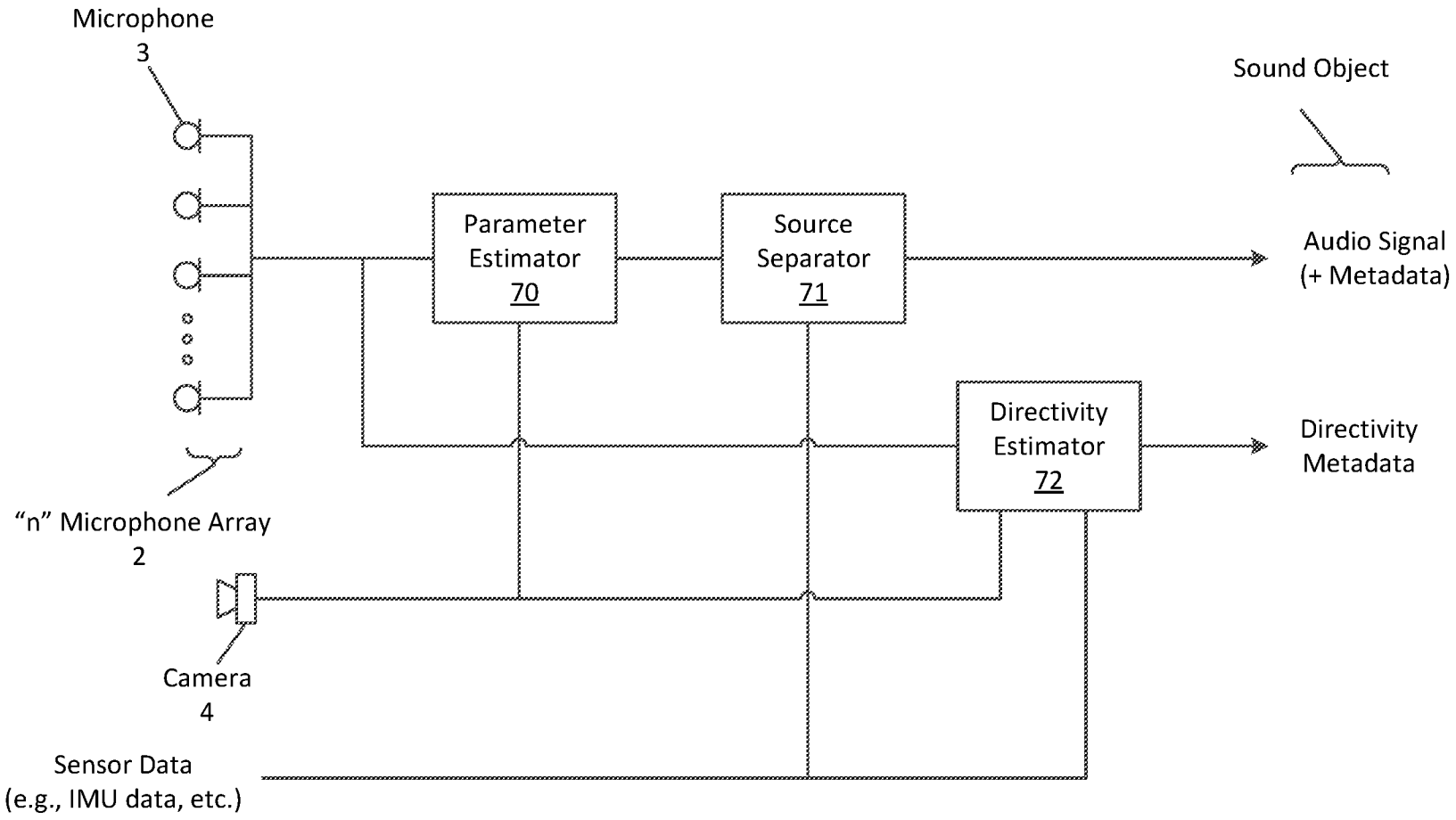
FIG. 2 shows a block diagram of operations performed by a sound object & sound bed identifier to identify a sound object according to one aspect of the disclosure.

In some aspects, the identifier 10 may employ other methods to identify a sound object. For instance, the source device 1 may leverage audio data (or audio signals) produced by the microphone array 2 and image data produced by the camera 4 to identify sound objects within the environment in which the device 1 is located. Specifically, the device 1 may identify a sound object (or object) within the environment through the use of object recognition algorithms and use the identification of the sound object to better steer (or produce) directional sound patterns towards the object, thereby reducing noise that may otherwise be captured using conventional pre-trained beamformers. FIG. 2 shows a block diagram of operations performed by a sound object & sound bed identifier 10 to identify and produce a sound object (and/or of a sound bed), according to one aspect of the disclosure. Specifically, this figure illustrates operations that may be performed by the identifier 10 of the (controller 5 of the) audio source device 1. As shown, the diagram includes a parameter estimator 70, a source separator 71, and a directivity estimator 72.

The parameter estimator 70 is configured to obtain 1) at least one microphone audio signal that is produced by the microphone array 2 and/or 2) image data captured by at least one camera 4. In one aspect, in lieu of (or in addition to) obtaining the microphone signals, the estimator 70 may obtain one or more of the ambient signals that are produced by the speech & ambient separator 7. The parameter estimator 70 is configured to estimate parameters of the sound source, such as a position of the sound source as position data (e.g., distance-to and angle-from the source, location of the source, etc.), loudness data (e.g., a SPL level), and any other sound characteristics associated with the sound source. In one aspect, the estimator may process the signals according to a sound source localization algorithm (e.g., based on the time of arrival of sound waves and the geometry of the microphone array 2). In another aspect, the estimator may process the image data captured by the camera 4 to identify the sound object (and/or the position of the sound object or source with respect to the device 1). For instance, the estimator may estimate a position of a sound object within an environment by performing an object recognition algorithm upon the image data to identify an object within the field of view of the camera. The algorithm may perform a table lookup into a data structure that includes objects that are associated with known sound objects (e.g., objects known as emitting sound or being sound sources), such as a person's mouth. From this the estimator 70 may determine descriptive data that describes physical characteristics of the object (e.g., color, type, size, etc.). The estimator is configured to produce metadata that contains at least some of the parameters that are estimated and/or data that is determined. In another aspect, the estimator may process the image data in combination with processing the audio signals to identify a sound source. In one aspect, the estimator 70 may track the activity of an identified object through the use of object recognition. For instance, the estimator 70 may adjust position data (e.g., velocity, distance, etc.) based on movement of an object, such as an identified helicopter flying in the sky.

The source separator 71 is configured to obtain the parameters (or metadata) that is estimated by the estimator 70 and perform source separation operations to produce an audio signal (or audio data) associated with the sound source from the microphone audio signals. For instance, the separation may be accomplished by clustering the direction of arrival (DOA) estimates in all time-frequency bins. The separator may improve DOA estimates by taking into account the estimated parameters (e.g., position data of an identified sound source, movement of the object, etc.). In one aspect, the separator may improve DOA estimates by compensating or taking into account sensor data from one or more on-board sensors. For instance, sensor data may include motion data that is produced by an inertial measurement unit (IMU) of the device 1. From the motion data, the identifier 10 may account for the position and/or orientation of the device 1 with respect to the sound source. In one aspect, the separator 71 may leverage a statistical property of independence of competing audio signals (or sound sources) and their sparseness in time and frequency domains.

In one aspect, the source separator 71 may perform beamforming operations upon at least some of the audio signals to adapt directional beam patterns towards a direction of a sound source to produce an output beamformer signal, according to the estimated parameters in order to produce an output beamformer signal that contains sound of a sound object. For example, the separator may adapt beamformer algorithms, such as multi-channel wiener filter (MCWF) or minimum variance distortionless response (MVDR) beamformers based on the position data indicated in the parameters. As a result, the separator may produce output beamformer signals that have a higher audio quality than a pre-trained beamformer. In one aspect, in the separator may use estimated parameters in a MVDR beamformer, for example, to perform a more granular identification of a sound source (or sound object). For instance, the separator may use parameters such as desired-source covariance and noise covariances to define a signal-to-noise ratio (SNR) with which spatial sound source data may be produced.

The directivity estimator 72 is configured to infer (or determine) a directivity of the sound object. In one aspect, the estimator 72 may determine the directivity function by performing a table lookup into a table that associates pre-measured functions with at least one of 1) predefined sound objects, 2) sound characteristics of sound objects, and 3) sound characteristics of sound objects with respect to movement of the device 1. Thus, the estimator 72 may perform similar operations to determine the identity of sound objects and/or determine sound characteristics of the sound object as described herein. For instance, the directivity estimator 72 may perform object recognition algorithms upon image data obtained from the camera 4, as described herein. Once an object is identified the estimator 72 may determine the object's position data with respect to the device 1 (e.g., using triangulation). In one aspect, when determining the position data, the estimator may take into account sensor data obtained from the one or more onboard sensors (e.g., IMU data, as described herein). Specifically, the estimator 72 may account for changes in the orientation and movement of the device 1. The metadata generator 62 may also generate descriptive data, as described herein. In one aspect, the table may be predefined or the table may be produced through the use of a machine learning algorithm. In one aspect, the estimator may obtain at least some of the estimated parameters from the parameter estimator (e.g., position data, descriptive data, etc.) that described the sound object to perform the directivity estimation. From the identified sound object, the identifier 10 may determine whether the sound object is stored within the sound library, as described herein.

In one aspect, the operations performed to identify a sound object (or sound bed) may be performed in the background (e.g., without the user's knowledge). In another aspect, however, the controller or an application that is being executed by the controller (e.g., a virtual person assistant (VPA) application may provide alerts to the user, while the identification operations are being performed. For instance, a VPA may provide verbal instructions to the user to move closer towards an object within the environment that is emitting a sound (e.g., "A bird is detected in front of you, please move closer") in order for the source separator 71 to produce more accurate or fine-grained spatial sound-source data (e.g., by narrowing the beamwidth of a beam pattern to reduce noise).

Figure 3:
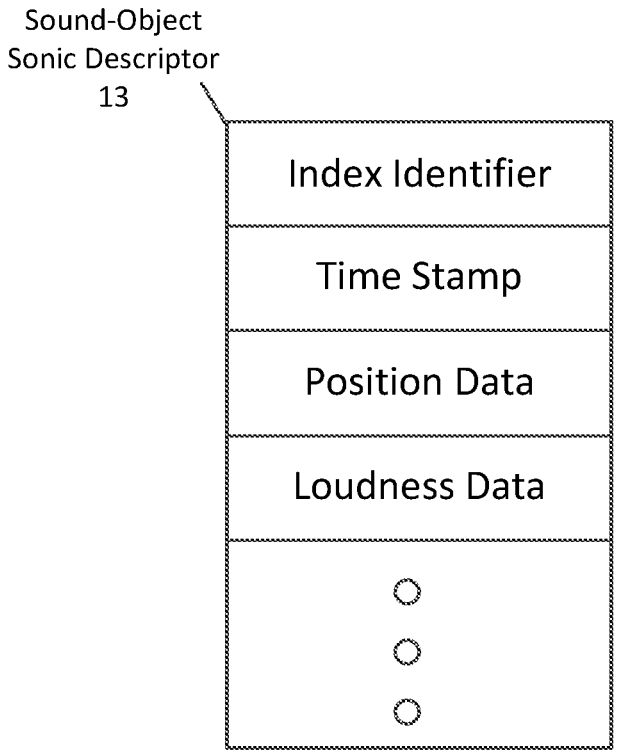
FIG. 3 shows a sound-object sonic descriptor produced by the audio source device according to one aspect of the disclosure.

Returning to FIG. 1, the identifier 10 is configured to produce (or generate) a sound-object sonic descriptor 13 that includes metadata associated with the identified sound object. For instance, the identifier 10 may produce the sound-object sonic descriptor 13 upon finding (or selecting) a matching predefined sound object's entry from the library 9 and add metadata into the descriptor, such as metadata from the library (e.g., an index identifier that corresponds to the matching predefined sound object) and/or metadata of the spatial sound-source data. FIG. 3 shows an example of such a sound-object sonic. For instance, the metadata of the descriptor 13 may include an index identifier of the matching entry, position data, loudness data, and a time stamp (e.g., the start and/or end time that the sound object is produced by the sound source, duration of the sound object, etc.). In one aspect, the descriptor 13 may include beamformer data of a beam pattern contained within the spatial sound-source data, such as directivity and beamwidth. In one aspect, the sound-object descriptor 13 may contain other metadata such as sound characteristics and/or descriptor data of physical characteristics of the sound object (or sound source). In another aspect, the descriptor 13 may contain only metadata from the matching entry, or may only contain metadata from the spatial sound-source data. As described herein, the sound-object sonic descriptor 13 may include more (or less) data (or metadata) of the identified sound object.

In one aspect, the identifier 10 is configured to generate a sound-bed sonic descriptor 14 that includes metadata that describes a sound bed (and/or an identified ambient or diffuse background sound that is a part of the sound bed. For instance, the metadata may be obtained from an entry from the library 9 that is associated with the sound, as described with respect to the sound-object sonic descriptor 13, such as an index identifier. In one aspect, the sound-bed sonic descriptor 14 may include similar metadata that is associated with the sound-object sonic descriptor 13, such as loudness data and position data. In one aspect, since the sound-bed descriptor 14 may describe a "generic" ambient sound (e.g., a sound with content that is not discernable from another similar sound that has similar content), the descriptor may include data that may be used to synthesize (or reproduce) the sound. For example, with respect to wind noise 15, the identifier 10 may include synthesizer data (e.g., frequency, filter coefficients) that a synthesizer at the audio receiver device 20 may use to synthesize the wind noise. In one aspect, the sound-bed sonic descriptor may include any data that indicates how to synthesize the sound (e.g., sound effects parameters, etc.).

In one aspect, since the sound bed may include one or more background noises or sounds associated with the environment, the sonic descriptor 14 may include metadata associated with each (or at least a portion) of the noises or sounds. In another aspect, the sound bed sonic descriptor 14 may include metadata for the sound bed. In other words, the sound library 9 may include entries that include metadata (and/or audio data) associated with different sound beds, such as a forest camp fire that includes crackling, owl sounds, and cricket sounds. In one aspect, upon identifying an ambient or diffuse background noise or sound, the identifier may produce the sonic descriptor 15 with metadata that is associated with a sound bed that includes the noise or sound.

In one aspect, the use (e.g., production and transmission) of a sound-bed sonic descriptor 14 may reduce the overall bandwidth required by the sound source device 1 to transmit audio data to the audio receiver device 20. For instance, since the sound bed within an environment may contain continuous or periodic sounds, the source device 1 may produce and transmit the sound-bed descriptor 14 one time, rather than every time the sound occurs. For instance, if a sound occurs every minute (e.g., the refrigerator condenser), the bed descriptor 14 may include time periods that the sound bed is to be synthesized (or reproduced) and outputted by the audio receiver device 20. In one aspect, the sound-bed descriptor 14 may be periodically produced and transmitted to the audio receiver device 20 (e.g., every time a new sound is identified as belonging to the sound bed). In another aspect, the sound-bed descriptor 14 may have a smaller file size than the sound-object sonic descriptor 13, since the sound bed may be more generic than a sound object, and therefore does not require as much data (e.g., such as position data with respect to wind noise that is diffuse within the environment).

In one aspect, the controller may perform at least some additional (or optional) operations. For instance, in some aspects, the controller 5 may include a phoneme identifier 12 that is configured to produce phoneme data from the speech signal. A phoneme is a unit of speech that distinguishes one word from another in a particular language. The phoneme identifier 12 obtains the speech signal produced by the separator 7 and performs an Automatic Speech Recognition (ASR) algorithm and/or a Speech-to-Text algorithm (or a phoneme recognition algorithm) upon the speech signal to produce speech (or phoneme) data that represents (a corresponding portion of) the speech signal as text. For instance, when the speech signal contains a spoken word "cat", the phoneme identifier 12 may produce a phoneme (e.g., text) for each letter, "c", "a", and "t". In one aspect, the phoneme identifier 12 may produce any type of speech data that represents the speech signal, such as grapheme data that is a letter or a number of letters that represents sounds of speech. In one aspect, the phoneme identifier 12 may use any method to produce this data from the speech signal. The phoneme identifier 12 produces a phoneme sonic descriptor 15 that includes the speech (or phoneme) data. In some aspects, the phoneme sonic descriptor has a lower file size than a corresponding portion of speech in the speech signal.

The network interface 6 is configured to obtain at least some audio data (e.g., any of the sonic descriptors 13-15 and the speech signal) for (e.g., wireless) transmission via a communication data link as an uplink signal to the audio receiver device 20. In one aspect, the audio source device 1 may transmit different combinations of this data based on the available bandwidth (or throughput) of the computer network. For instance, if the source device 1 is transmitting speech data and a sound bed sonic descriptor and there is little available (Internet or wireless) bandwidth (e.g., falls below a first threshold value), the source device 1 may be prevented from transmitting the sound bed sonic descriptor and continue to transmit the speech signal. As another example, if the bandwidth or available throughput falls again (e.g., below a second threshold), the source device may transmit the phoneme sonic descriptor 15 to the audio receiver device 20 in lieu of the speech signal, since the speech signal will consume more bandwidth than the phoneme sonic descriptor 15. Although this may not be preferred (since the speech signal will sound more natural to the user of the audio receiver device 20), the substitution may allow the audio source device 1 to continue a communication session with the audio receiver device 20 even when there is minimal bandwidth. More about how the audio source device 1 determines which data to transmit is described herein.

In one aspect, the audio source device 1 may compress the speech audio signal using any known method, in order to reduce the required bandwidth to conduct the communication session. In another aspect, the speech audio signal may not be compressed.

In one aspect, the descriptors (e.g., phoneme sonic descriptor 15, sound-bed sonic descriptor 14, and/or sound-object sonic descriptor 13) may be a file (e.g., a data structure) that is stored as any type of file format (e.g., a DAT file, a TEXT file, etc.). In another aspect, the descriptors may be encoded (or embedded) into an audio stream that is being transmitted from the source device 1 to the receiver device 20 in any type of audio format (e.g., AAC, WAV, etc.).

In some aspects, the source device 1 may transmit at least some of the descriptors in real-time to the audio source device 20. In another aspect, the descriptors may be transmitted to an electronic server that may store the descriptors and may transmit the descriptors to the receiver device 20 at a later time. In that case, the descriptors may be transmitted as separate data files, or they may be embedded into other data streams that are being transmitted to the receiver device 20. As an example, when the audio receiver device 20 is presenting audio and/or image data of a CGR environment, the descriptors may be embedded into CGR environment image data files that are transmitted by the server to the receiver device for rendering the CGR environment, such as Universal Scene Description (USD) format.

In another aspect, the source device 1 may transmit image (or video) data captured by the camera 4, along with at least some of the descriptors. For example, when the source device and the receiver device 20 are engaged in a video conference call, the image data, descriptors, and/or a speech signals may be exchanged between both devices.

Figure 4:
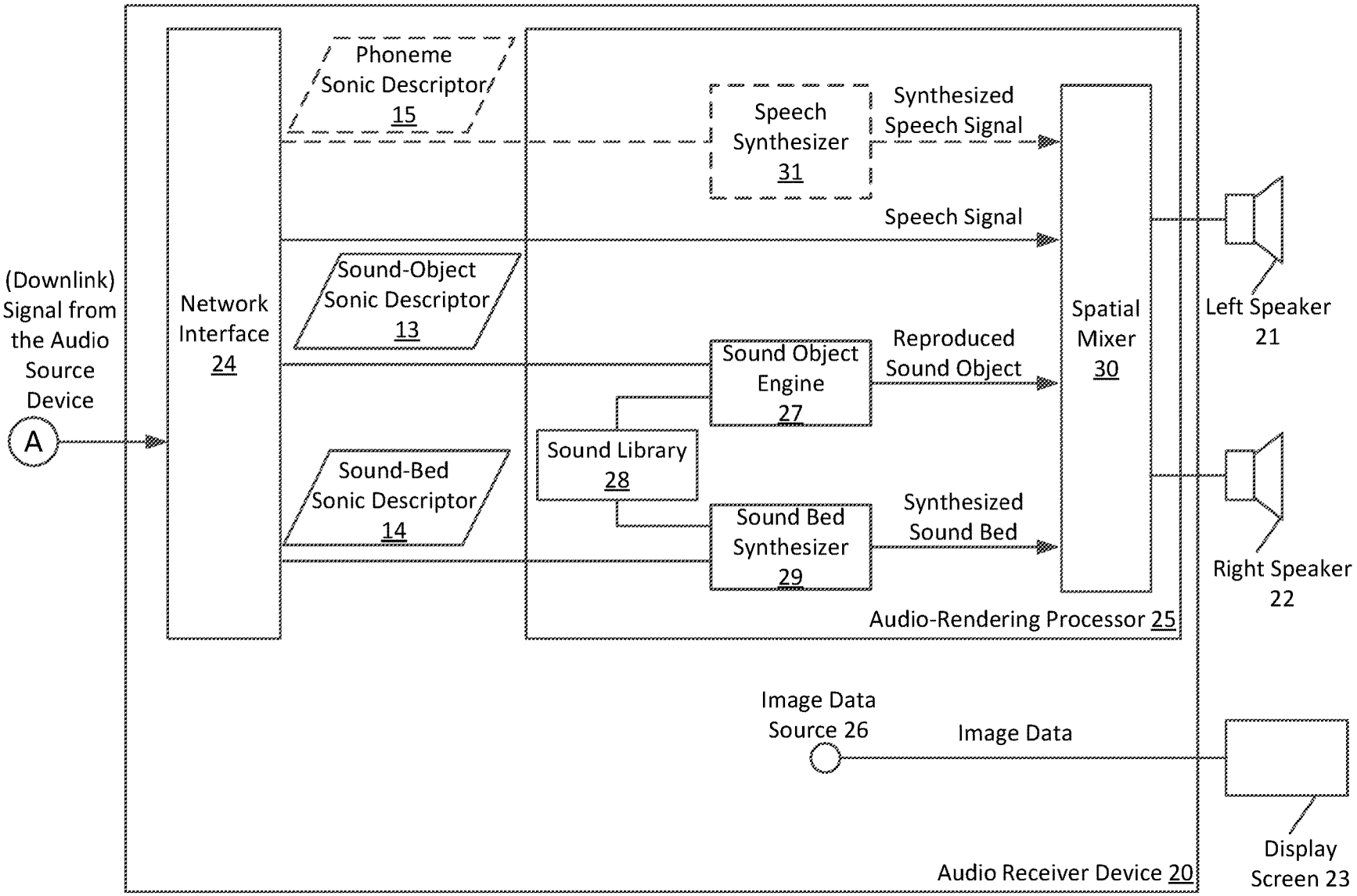
FIG. 4 shows a block diagram of an audio receiver device according to one aspect of the disclosure.

FIG. 4 shows a block diagram of the audio receiver device 20 according to one aspect of the disclosure. The audio receiver device 20 includes a left speaker 21, a right speaker 22, at least one display screen 23, a network interface 24, an audio-rendering processor 25, and an image source 26. In one aspect, the audio receiver device 20 may be any electronic device that is configured to obtain audio data via a communication data link as a downlink signal from the audio source device 1 for presentation by outputting the audio data through speakers 21 and/or 22. In one aspect, the audio receiver device 20 may be the same (or similar) to the audio source device. For example, both devices may be HMDs, as described herein. As a result, the audio source device 1 may include at least some of the components (or elements) of the audio receiver device 20, and vice a versa. For instance, both devices may include a display, a microphone array, and/or the speakers, as described herein. In another aspect, the receiver device 20 may be a companion device to the source device. For instance, the source device 1 may be a HMD that is communicatively coupled (or paired) using any wireless protocol, such as BLUETOOTH with the audio receiver device 20, which may be another device, such as a smart phone, laptop, desktop, etc.

The speaker 21 may be an electrodynamic driver that may be specifically designed for sound output at certain frequency bands, such as a woofer, tweeter, or midrange driver, for example. In one aspect, the speaker 21 may be a "full-range" (or "full-band") electrodynamic driver that reproduces as much of an audible frequency range as possible. The speaker "outputs" or "plays back" audio by converting an analog or digital speaker driver signal into sound. In one aspect, the receiver device 20 includes a driver amplifier (not shown) for the speaker that can receive an analog input from a respective digital-to-analog converter, where the later receives its input digital audio signal from the processor 25.

As described herein, the receiver device 20 may be any electronic device that is capable of outputting sound through at least one speaker 21. For instance, the receiver device 20 may be a pair of in-ear, on-ear, or over-the-ear (such as closed-back or open-back) headphones, where the left speaker 21 is in a left ear cup and the right speaker 22 is in a right ear cup. In one aspect, the receiver device is at least one earphone (or earbud) that is configured to be inserted into an ear canal of the user. For instance, the receiver device 20 may be a left ear bud that includes the left speaker 21 for the user's left ear.

In one aspect, in addition to (or in lieu of) the left and right speakers, the receiver device may include an array of speakers that includes two or more "extra-aural" speakers that may be positioned on (or integrated into) a housing of the receiver device 20 and arranged to project (or output) sound directly into the physical environment. This is in contrast to earphones (or headphones) that produce sound directly into a respective ear of the user. In one aspect, the receiver device 20 may include two or more extra-aural speakers that form a speaker array that is configured to produce spatially selective sound output. For example, the array may produce directional beam patterns of sound that are directed towards locations within the environment, such as the ears of the user.

The display screen 23, as described herein, is configured to display image data and/or video data (or signals) to a user of the receiver device 20. In one aspect, the display screen 23 may be a miniature version of known displays, such as Liquid Crystal Displays (LCDs), Organic Light-Emitting Diodes (OLEDs), etc. In another aspect, the display may be an optical display that is configured to project digital images upon a transparent (or semi-transparent) overlay, through which a user can see. A display screen 23 may be positioned in front of one or both of the user's eyes. In one aspect, the audio receiver device 20 may not include the display screen 23. In one aspect, the audio receiver device 20 may obtain image data from an image data source 26 (e.g., internal memory), and present the image data on the display screen 23. In another aspect, the audio receiver device 20 may obtain image data from a remote location (e.g., from a remote server, or from the audio source device 1), via a communication data link.

In one aspect, at least some of the elements of the audio receiver device 20 may be separate electronic devices that the device 20 is communicatively coupled (e.g., paired) to. For example, the left speaker 21 and the right speaker 22 may be separate wireless earphones (or ear buds) that are wirelessly coupled (e.g., via BLUETOOTH protocol) with the receiver device 20.

The network interface 24 is configured to establish a communication data link, via a computer network, with the audio source device to obtain audio data, as described herein. Specifically, the network interface 24 may obtain at least one of the sonic descriptors 13-15 and/or the speech signal from a downlink signal that is obtained from (or transmitted by) another electronic device, such as the source device 1.

The audio-rendering processor 25 may be implemented as a programmed processor, digital microprocessor entirely, or as a combination of a programmed processor and dedicated hardwired digital circuits such as digital filter blocks and state machines. The processor 25 is configured to obtain audio data from the network interface 24 and spatially render (or reproduce) the audio data for output through the speakers 21 and 22. The processor 25 includes a sound object engine 27, a sound library 28, a sound bed synthesizer 29, a spatial mixer 30, and (optionally) a speech synthesizer 31. The sound library 28 may be the same (or similar) to sound library 9 of the audio source device 1. In one aspect, both libraries may share at least some entries and/or at least some of the data associated with those entries. More about the similarities (or differences) between the libraries is described herein.

The sound object engine 27 is configured to obtain a sound-object sonic descriptor 13 and to reproduce the sound object that is associated with the sonic descriptor. Specifically, the engine 27 may perform a table lookup into the sound library 28 using metadata contained within the sonic descriptor 13, such as an index identifier. Upon finding a matching index identifier of an entry within the sound library 28, the engine 27 selects the sound object associated with the entry. The engine 27 reproduces the selected sound object, which may include audio data (e.g., PCM digital audio) that is stored within the entry. In one aspect, the reproduced sound object may include at least some metadata from the entry and/or metadata from the sonic descriptor 13, such as loudness data (e.g., SPL, LKFS, etc.) and position data (e.g., azimuth, elevation, direction, beamformer data, etc.) that may be used by the mixer to spatially render the sound object at an appropriate (virtual) location. For instance, if both devices are engaged in phone call (or conference call) in which both users of the devices are facing one another, and the dog bark 17 occurs to the left of the user of the source device 1, a sound object of the dog bark reproduced by the receiver device 20 may output the reproduction of the bark to the right of the user of the receiver device 20, since when two people are speaking, they normally face each other. In another aspect, sound objects may be positioned at any location within a sound space produced by the speakers 21 and 22. More about spatially rendering audio data is described herein.

Similarly, the sound bed synthesizer 29 is configured to obtain a sound-bed sonic descriptor 14 and to produce a synthesized sound bed that is associated with the sonic descriptor. For instance, the synthesizer 29 may use an index identifier associated with the sound-bed descriptor 14 to obtain audio data of a corresponding entry from the library 28. As another example, the synthesizer 29 may use data in the sonic descriptor 14 to synthesize the sound bed. For instance, the synthesizer 29 may use parameters of the descriptor (e.g., synthesizer parameters, such as frequency and filter coefficients, sound effects parameters, etc.) to reproduce the sound bed. In one aspect, audio files (wavelets or PCM audio) of the sound bed may be stored within the sound library 28. As a result, the synthesizer 29 may determine which audio files may be associated with the sound bed and retrieve them from the library 28.

The speech synthesizer 31 is configured to (optionally) obtain the phoneme sonic descriptor 15 and synthesize a speech signal based on the phoneme data contained within the sonic descriptor. Specifically, the speech synthesizer uses the phoneme data to produce a synthesized speech signal. In one aspect, the synthesizer 31 may use any method to synthesize speech from the phoneme data (e.g., a text-to-speech algorithm, etc.) In one aspect, the produced synthesized speech signal may be synthesized to be different than the speech signal that is produced by the separator 7 (and obtained by the network interface 24). For instance, the synthesizer 31 may produce the synthesized speech signal to sound different than the speech signal by having different timbre, tone, etc. As another example, the synthesizer 31 may produce the synthesized speech signal to have a different voice (or accent) than a voice (or accent) within the original speech signal. As yet another example, the speech synthesizer 31 may use the (phoneme data contained within the) phoneme sonic descriptor 15 to synthesize a speech signal that is a different language from the speech 16 that was captured by the source device's microphone array. For instance, the synthesizer 31 may employ a translation application that translates the phoneme data to the different language and synthesizes the translated phoneme data into a translated speech signal. In one aspect, this may be a pre-defined user-setting of the audio receiver device. In another aspect, the speech synthesizer 31 may be a part of a virtual person assistant (VPA) application that is executing within the audio receiver device 20. As a result, the synthesized speech signal may include speech of the VPA.

The spatial mixer 30 is configured to obtain reproduced or synthesized audio data, such one or more 1) synthesized speech signals (produced by the speech synthesizer 31), 2)

speech signals, 3) reproduced sound objects, and/or 4) synthesized sound beds, and to perform spatial mixing operations (e.g., matrix mixing operations, etc.) to produce a driver signal for at least one of the left speaker 21 and the right speaker 22. Thus, in the case of a speech signal containing speech 16, a descriptor 13 of the bark 17, and a descriptor of the wind 18, the spatial mixer is configured to spatially mix reproduced audio data of each three in order to output each of the sounds through the left speaker 21 and the right speaker 22.

In one aspect, the spatial mixer 30 may use data obtained with a sonic descriptor (13, 14, and/or 15) to output sound. For instance, in the case of a sonic descriptor 13 for the dog bark 17, the descriptor's metadata may indicate a start/stop time of the dog bark 17. Thus, the spatial mixer 30 may output (e.g., the reproduction of) the dog bark 17 within that time period. In another aspect, the spatial mixer 30 may output a sound object in sync with presentation of image data on the display screen 23. For instance, when the display screen is presenting a VR setting that includes a dog, the dog bark may be outputted when the mouth of the dog in the VR setting moves.

In one aspect, the spatial mixer 30 may spatially render sound at a virtual sound source produced by the speakers 21 and 22 that corresponds to a physical location (or position) at which the sound (e.g., sound object) is detected within the environment in which the source device 1 is located. For example, the spatial mixer 30 may apply spatial filters (e.g., head-related transfer functions (HRTFs)) that are personalized for the user of the receiver device 20 in order to account for the user's anthropometrics. In this case, the spatial mixer 30 may produce binaural audio signals, a left signal for the left speaker 21 and a right signal for the right speaker 22, which when outputted through respective speakers produces a 3D sound (e.g., gives the user the perception that sounds are being emitted from a particular location within an acoustic space). In one aspect, when there are multiple sounds, the spatial mixer 30 may apply spatial filters separately to each (or a portion of the sounds) and then mix the spatially filtered sounds into a set of mixed signals.

As described herein, the audio receiver device 20 may obtain audio data while engaged in a communication session with the audio source device 1. In one aspect, this communication session may take place in a VR setting, in which avatars associated with the users are participating. These avatars may perform actions (e.g., move, talk, etc.) based on user input that may be received through the source (or receiver) device and/or a companion device that is communicatively coupled to the source device (e.g., a remote control). In one aspect, HRTFs may be general or personalized for the user, but applied with respect to the user's avatar in the VR setting. As a result, spatial filters associated with the HRTFs may be applied according to a position of virtual sound sources within the VR setting with respect to the avatar to render 3D sound of the VR setting. These virtual sound sources may be associated with the sound objects that correspond to the sonic descriptor 13, where the location of the virtual sound sources correspond to the position of the position data from the sonic descriptor. This 3D sound provides an acoustic depth that is perceived by the user at a distance that corresponds to a virtual distance between the virtual sound source and the user's avatar. In one aspect, to achieve a correct distance at which the virtual sound source is created, the mixer 30 may apply additional linear filters upon the audio signal, such as reverberation and equalization.

Figure 5:
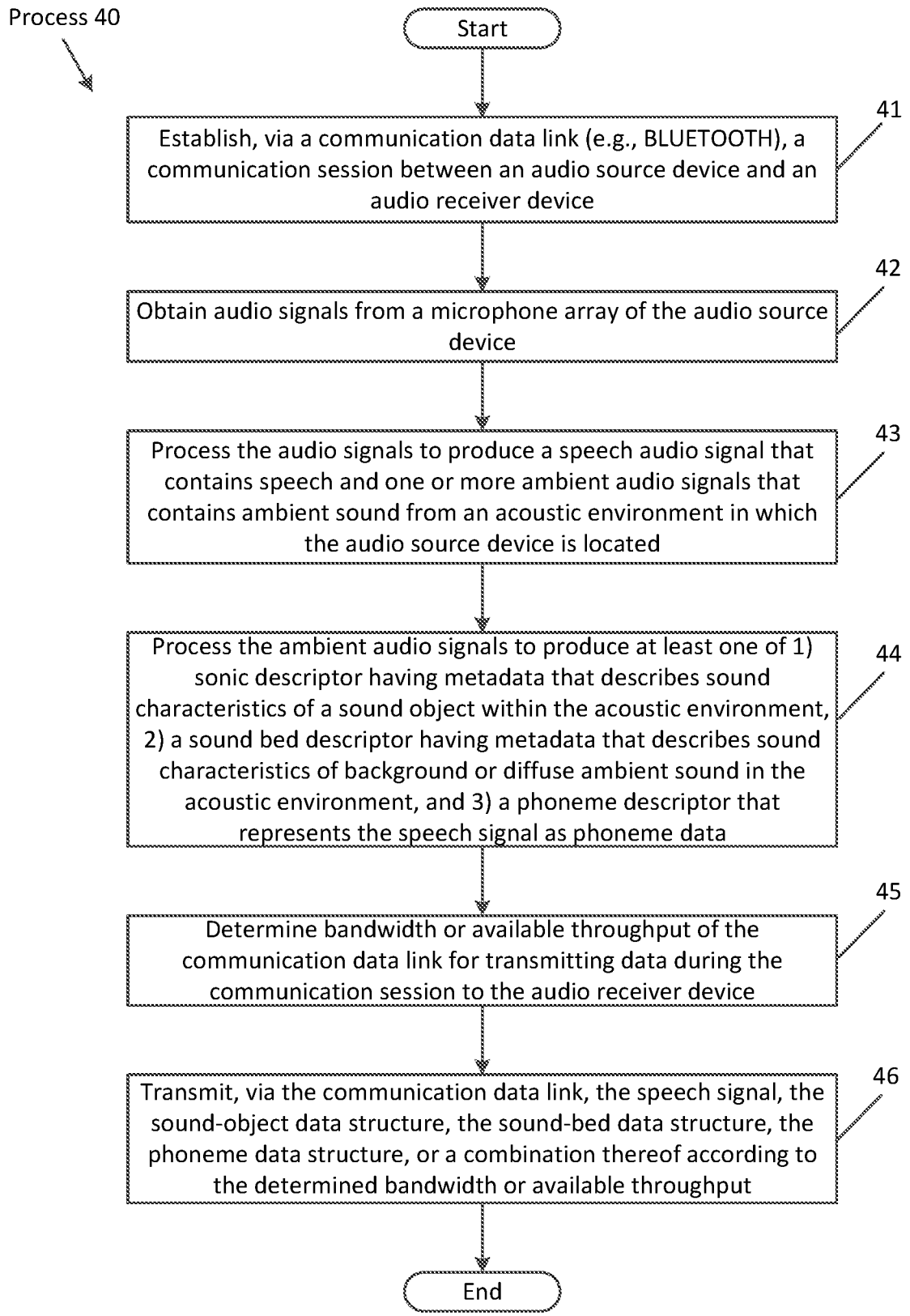
FIG. 5 is a flowchart of one aspect of a process to reduce bandwidth that is required to transmit audio data.

FIG. 5 is a flowchart of one aspect of a process 40 to reduce bandwidth that is required to transmit audio data from an audio source device 1 to an audio receiver device 20 (and vice a versa). In one aspect, at least a portion of the process 40 may be performed by the (e.g., controller 5 of the) audio source device 1 and/or the audio receiver device 20. For instance, both devices may perform the process 40 in order to reduce bandwidth requirements on each respective side. The process 40 begins by establishing, via a communication data link and over a computer network, a communication session between an audio source device 1 and an audio receiver device 20 (at block 41). For example, both devices may pair with one another in order to engage in a (e.g., VoIP) phone call or conference call with another device over the Internet. In another aspect, both devices may be HMDs that are participating in a VR setting. The process 40 obtains, from a microphone array 2, one or more audio signals (at block 42). The process 40 processes the audio signals to produce a speech signal that contains speech and one or more ambient signals that contains ambient sound from an acoustic environment in which the audio source device is located (at block 43). The process 40 processes the ambient signals to produce at least one of 1) a sound-object sonic descriptor that has metadata that describes (e.g., sound characteristics, etc.) of a sound object within the acoustic environment, 2) a sound-bed sonic descriptor that has metadata that describes sound characteristics of background ambient sound associated with the acoustic environment (or a sound bed), and 3) a phoneme sonic descriptor that represents the speech signal as phoneme data, as described herein (at block 44).

The process 40 determines bandwidth or available throughput of the communication data link for transmitting data during the communication session to the audio receiver device 20 (at block 45). In one aspect, the audio source device 1 may use any (known or unknown) method to determine the bandwidth or available throughput of the communication data link. For instance, the audio source device 1 may determine the bandwidth or throughput by transmitting a data file to the audio receiver device 20 of a certain size and dividing the size by a round-trip time. In one aspect, the audio source device may determine the available throughput based on a current combined throughput of other applications that are executing in the audio source device and transmitting data over the network. In another aspect, the audio source device may use any bandwidth test software to determine bandwidth of the network. In another aspect, the audio source device 1 may determine the bandwidth or available throughput based on a size of an output buffer that temporality stores data (packets) for wireless transmission. If the buffer is empty, it may indicate that the device 1 has a significant amount of available throughput (e.g., above a threshold), while if the buffer is filling up, this may indicate that there is little available throughput (e.g., below the threshold). In one aspect, the bandwidth may be user-defined (e.g., in a user-settings menu). In another aspect, the bandwidth or available throughput may be set by any device on the computer network (e.g., the router, another device that has an Internet connection over the network, etc.). For instance, if there are other devices that are on the (wireless) network, the router (or modem) may give each device, including the audio source device 20 Mbps.

In another aspect, the available bandwidth may be based on the throughput of a separate network on which the audio receiver device 20 is connected. In one example, the audio source device 1 may be paired with the audio receiver device 20 that in turn is engaged in a VoIP phone call. In this case, the audio receiver device 20 may communicate over a computer network (to another device). As another example, both devices may be communicatively coupled over different wireless networks. In both these cases, the audio receiver device 20 may perform similar operations as the audio source device for determining the device's bandwidth or available throughput, and transmit this value to the audio source device.

The process 40 transmits, via the communication data link and over the computer network, the speech signal, the sound-object sonic descriptor 13, the sound-bed sonic descriptor 14, the phoneme sonic descriptor 15, or a combination thereof according to the bandwidth or available throughput (at block 46). For instance, the audio source device 1 may determine the amount of data (e.g., kb, mb, etc.) that is necessary to transmit different combinations of the above-mentioned audio data in a period of time (e.g., one second). For instance, the controller 5 may determine how much speech data is to be transmitted during one second. In one aspect, this determination may be based on several factors, such as sampling frequency, bit depth, and whether or not the signal is compressed. In addition, the controller 5 may determine the file size of each of the sonic descriptors. Once each is determined, the controller 5 may build a table of different combinations. In one aspect, the table is ordered (in descending order) from the most audio data to the least audio data that may be transmitted. For instance, the most audio data for transmission may include the speech signal and all of the sonic descriptors, while transmitting only one of the sonic descriptors (e.g., the sound-bed sonic descriptor) may require the least amount of data. The controller 5 may then determine how much data (e.g., threshold data) may be transmitted during that period of time (e.g., based on the bandwidth or throughput). The controller 5 then determines whether to transmit the signal and/or sonic descriptors separately from one another or in a particular combination based on a table lookup into the built table, using the threshold data.

In one aspect, the controller 5 may determine which audio data to transmit based on a priority of the audio data. Specifically, some audio data may have a higher priority of importance than other data. For example, the priority order may be as follows: the speech signal, the sound-object sonic descriptor, the sound-bed sonic descriptor, and the phoneme sonic descriptor. Thus, the controller 5 may attempt to transmit the speech signal if there is sufficient bandwidth, even though doing so may result in not transmitting any of the sonic descriptor. In another aspect, the controller 5 may attempt to transmit the speech signal with the sound-object sonic descriptor when possible. If not, however, the controller 5 may then attempt to transmit the speech signal with the sound-bed sonic descriptor. It should be understood that any combination is possible for transmitting audio data during a communication session.

In another aspect, the controller 5 may determine what audio data to transmit based on a previous transmission. For instance, as described herein, the sound-bed sonic descriptor may not necessarily need to be transmitted frequently, since a sound bed of the environment may not change very often. Thus, the controller 5 may determine how long since the sound-bed sonic descriptor has been transmitted to the audio receiver device and determine whether this time is less than a threshold time. If so, the controller 5 may not transmit the sound-bed sonic descriptor, thereby allowing other sonic descriptors to be transmitted instead.

Some aspects perform variations of the process 40. For example, the specific operations of the process 40 may not be performed in the exact order shown and described. The specific operations may not be performed in one continuous series of operations and different specific operations may be performed in different aspects. For instance, rather than process the audio signals to produce the speech signal and the one or more audio signals at block 43, the controller may only produce one or more audio signals that contain sound(s) from the acoustic environment (or only the speech signal). In this case, the identifier 7 may only produce the n ambient audio signals. As a result, the controller may process at least some of the n ambient audio signals to produce one or more sonic descriptors (e.g., sound-object and/or sound-bed), and transmit the sonic descriptors to the audio receiver device 20, as described herein.

In another aspect, the controller may determine the bandwidth or available throughput at block 45 before processing the ambient signals to produce at least one of the sonic descriptor. Specifically, the controller 5 may determine how much bandwidth or throughput is available for transmitting audio data. Once determined, the controller 5 may what audio data is to be transmitted. This determination may be based on previous (or average) data sizes of the speech signal and/or sonic descriptors. Once determined, the controller 5 may process the ambient signals to produce the sonic descriptors that are to be transmitted. In one aspect, when the source device is to transmit only the speech signal, the operations of block 44 may be omitted entirely.

The amount of data to transmit one second of speech signal may be based on several factors (e.g., the sampling frequency, bit depth, and whether the signal is compressed or uncompressed, such as PCM audio). In one aspect, the speech signal will require more bandwidth than either of the sonic descriptors. The amount of data that may be transmitted during that period of time (e.g., by multiplying the available bandwidth by the period of time).

Figure 6:
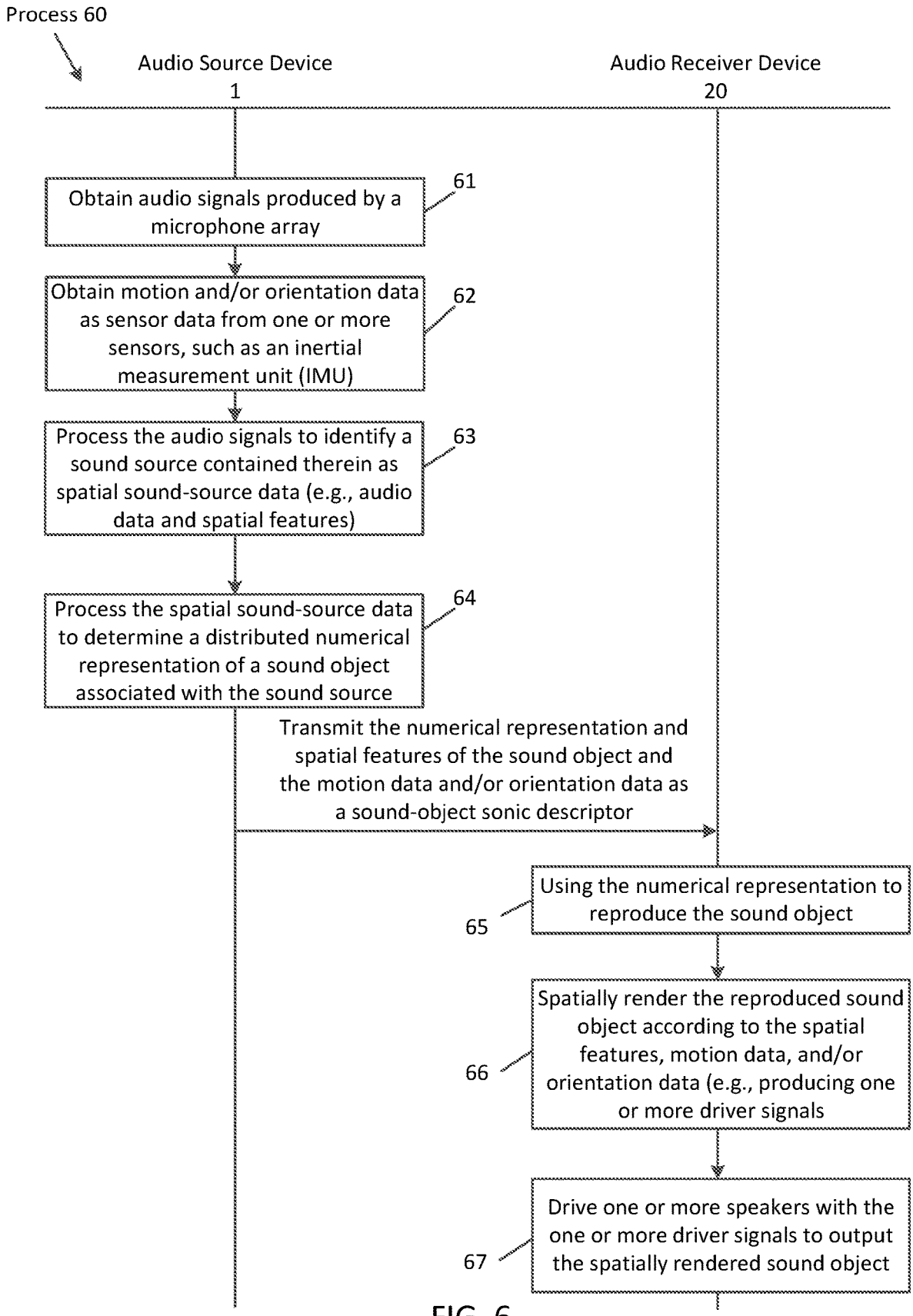
FIG. 6 is a signal diagram of a process for an audio source device to transmit lightweight sound representations of sound objects and for an audio receiver device to use the representations to reproduce and playback the sound objects according to one aspect of the disclosure.
Figure 7:
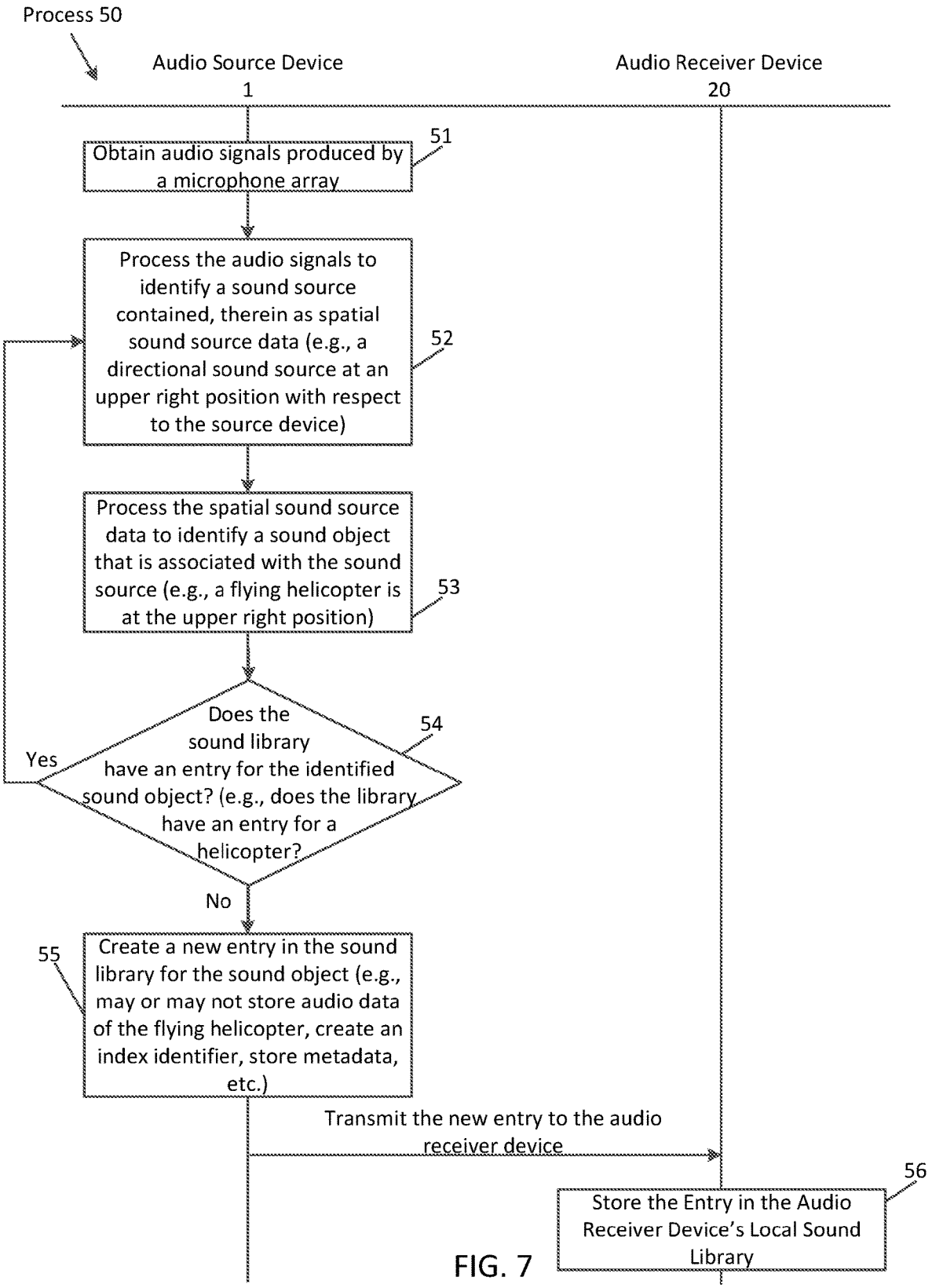
FIG. 7 is a signal diagram of a process for building and updating a sound library.

FIGS. 6 and 7 are signal diagrams of processes that may be performed by the (e.g., controller 5 and/or network interface 6 of the) audio source device 1 and by the (e.g., audio-rendering processor 25 and/or network interface 24 of the) audio receiver device 20. For example, the audio source device 1 may perform operations associated with blocks 61-64 in order to process one or more audio signals to produce a sonic descriptor that contains at least a numerical representation of an identified sound object, while the audio receiver device 20 may perform operations associated with blocks 65-67. In another aspect, either of the devices may perform more or less operations. Thus, each of these figures will be described with reference to FIGS. 1-4.

Turning to FIG. 6, this figure is a signal diagram of a process 60 for the audio source device 1 to transmit lightweight sound representations (e.g., as sonic descriptors) of sound objects and for the audio receiver device 20 to use the representations to reproduce and playback (output) the sound objects according to one aspect of the disclosure. The process 60 begins by obtaining, from one or more microphones of the microphone array 2, one or more (microphone) audio signals (at block 61). In one aspect, the audio signals may be one or more ambient audio signals that are obtained from the speech & ambient separator 7. The process 60 obtains motion and/or orientation data as sensor data from one or more sensors, such as an IMU (at block 62). For example, the source device 1 may include one or more IMU's, each configured to produce orientation data that indicates the orientation of the device 1 (and therefore the user, when the user is wearing the device), and/or to produce motion data that indicates speed and/or direction of movement.

The process 60 processes (one or more of) the audio signals to identify a sound source contained therein as spatial sound-source data, which includes audio data (signal) and/or spatial features of the source (at block 63). Specifically, the sound object & sound bed identifier 10 may perform operations described herein to identify one or more sound sources to produce the spatial sound-source data. In one aspect, the spatial features may include position data that indicates the position of the sound source with respect to the source device 1. In another aspect, the identifier 10 may perform sound source separation operations, as described with respect to the source separator 71 of FIG. 2. For example, the identifier may cluster DOA estimates in some (or all) time-frequency bins of the audio signals to identify sound sources. In another aspect, the identifier 10 may perform any method to separate sound sources (e.g., each source being associated with an audio signal (or data) and/or spatial features). The process 60 processes the spatial sound-source data to determine (or generate) a distributed numerical representation of a sound object associated with at least one sound source (at block 64). For example, the (identifier 10 of the) audio source device 1 may perform a distributed algorithm that analyzes features (characteristics) of the spatial sound-source data, more specifically the audio data, to identify a corresponding sound object with similar (or the same) features. For instance, the distributed algorithm may compare features of the sound-source data (e.g., spectral content of the audio data) with predetermined features (e.g., stored within the sound library 9), and may select the corresponding sound object with similar (or matching) features. For example, when the sound object is a dog bark 17, the numerical representation may be associated with a similar (or a same) dog bark. In one aspect, the determined distributed numerical representation may be a vector of one or more values, each value associated with a feature of the sound object.

In one aspect, the distributed algorithm may be a machine learning algorithm that is configured to determine a distributed numerical representation of a sound object by mapping values associated with features of the object to a vector. In another aspect, the machine learning algorithm may include one or more neural networks (e.g., convolution neural networks, recurrent neural networks, etc.) that are configured to determine the numerical distribution. For example, the algorithm may include a Visual Geometry Group (VGG) neural network.

The process 60 transmits a sound-object sonic descriptor that includes the numerical representation and the spatial features of the sound object and the motion data and/or orientation data (e.g., as metadata), such as descriptor 13. In one aspect, the sonic descriptor may contain other The process 60 uses the numerical representation to reproduce (or retrieve) the sound object as audio data (at block 65). For example, the sound object engine 27 may obtain the sound-object sonic descriptor 13 that includes the representation, and retrieve the sound object that is associated with the representation. For example, the engine performs a table lookup into the sound library 28 using the numerical representation to select a sound object with a matching associated numerical representation. In another aspect, the engine may retrieve a sound object from the sound library that is closest (e.g., similar) to the original sound object. For example, the engine may select a sound object with a numerical representation from the sound library that is closest, such as having numerical values that are closer to the received numerical representation (e.g., within a threshold) than corresponding numerical values associated with other sound objects within the sound library. As a result, the sound object that is retrieved from the sound library may be similar to the original sound object identified by the audio source device, but not exact.

The process 60 spatially renders the reproduced sound object (e.g., audio according to the spatial features, motion data, and/or orientation data, which was obtained from the sonic descriptor of the numerical representation associated with the reproduced sound object, thereby producing one or more driver signals (at block 66). For example, the spatial mixer 30 may determine one or more spatial filters (e.g., HRTFs) according to the spatial features, motion data, and/or orientation data (e.g., by performing a table lookup into a data structure that associates HRTFs with such data). Once determined, the mixer may apply the audio data (signal) to the HRTFs, thereby producing binaural audio signals as driver signals. The process 60 drives one or more speakers (e.g., speaker 21 and 22) with the driver signals to output the spatially rendered sound object (at block 67).

In one aspect, the process 60 may be performed for one or more sound objects at any given time. As a result, the spatial mixer may mix binaural audio signals that are determined by spatially rendering each sound object, in order to output a mix of the binaural audio signals.

FIG. 7 is a signal diagram of a process 50 for building and updating a sound library. In one aspect, the operations described herein, may be performed by the (e.g., controller 5 and/or network interface 6 of the) audio source device 1. As described herein, both the source device 1 and the receiver device 20 may include sound libraries (e.g., 9 and 28, respectively) that include entries for one or more predefined sound objects and/or sound beds. In some instances, however, a sound object (or sound bed) may be identified (e.g., by the sound object & sound bed identifier 10) that does not have a corresponding entry in at least one of the libraries. As a result, entries may be created in either library, during a communication session. In one aspect, the sound library may be built by either device off-line (e.g., while not engaged in the communication session). More about building the sound library off-line is described herein.

The process 50 begins by obtaining audio signals produced by a microphone array of the audio source device 1 (at block 51). For instance, the controller 5 may obtain and use the audio signals produced by the microphone array 2 for building and updating the sound library 9. In one aspect, the controller 5 may obtain the ambient signals that are produced by the speech & ambient separator 7. The process 50 processes the audio signals to identify a sound source contained therein, as spatial sound source data (at block 52). The process 50 processes the spatial sound source data to identify a sound object that is associated with the sound source (at block 53). For example, as described herein, the sound object & sound bed identifier 10 may use sound characteristics associated with spatial sound source data to identify the sound as a sound object (e.g., a particular sound, such as a flying helicopter that is at an upper right position) or as part of a sound bed (e.g., a background noise). As another example, the identifier 10 may use image data in connection with (or in lieu of) the sound characteristics (or sound source data) to identify an object associated with the sound source. Once an object is identified (e.g., within a field of view of the camera), the identifier 10 may process the audio signals according to the image data to identify the sound object (e.g., a dog or a flying helicopter in an upper right position of the field of view). The process 50 determines whether the sound library (e.g., 9) has an entry for the identified sound object or sound bed (e.g., does the library have an entry for the flying helicopter?) (at decision block 54). For instance, the sound object & sound bed identifier 10 may perform a table lookup using the sound object to determine whether the library includes a corresponding entry for the sound object, as described herein. If yes, the process 50 returns to block 52 to repeat the process for a different spatial sound source.

If, however, the identifier 10 determines that the sound library does not have an entry associated with the identified sound object, the process 50 creates (or produces) a new entry in the sound library for the identified sound object (at block 55). In one aspect, the entry may be the same or similar to the sonic descriptors described herein. The entry may include at least a portion of the spatial sound-source data (e.g., audio data and/or metadata, such as position data of the sound source, etc.), time stamp information, loudness data, and other sound characteristics that may be derived from the spatial sound-source data, as described herein. In one aspect, the identifier 10 may assign (or create) a unique index identifier for sound object and store it in the new entry. In another aspect, the identifier 10 may indicate whether the sound object is associated with the sound bed, as described herein. For instance, the identifier 10 may determine how diffuse the sound source is, and based on the diffusiveness of the sound, may determine that the source is a part of the sound bed. In another aspect, the identifier 10 may produce the entry and wait a period of time (e.g., one second, 30 seconds, etc.) to determine whether the source is continuous, and therefore a part of the environment. If not, the source may be determined to be a sound object and not a part of the sound bed. In another aspect, the new entry may include descriptive data that describes physical characteristics of the sound object, as described herein.

In one aspect, any information (or data) that is included in the new entry may be automatically determined by the controller 5 (e.g., through a machine learning process). In another aspect, the device 1 may obtain user input for at least some of the information included in the entry. For instance, upon creating the entry, a user of the device 1 may enter (e.g., through a touch-screen of the device or voice command) the information (e.g., physical characteristics, etc.). The entry is then stored in local memory of the device 1.

The process 50 transmits the new entry to the audio receiver device 20. In one aspect, the transmitted entry may include at least some of the metadata that was populated by the identifier 10. In another aspect, the transmitted entry may include audio data (e.g., PCM digital audio) of the sound source and/or at least some of the metadata. Thus, when the sound source is later (or subsequently) identified by the audio source device, a sound-object sonic descriptor or a sound-bed sonic descriptor may be produced and transmitted to the audio receiver device for rendering a reproduction of sound, as described herein. The audio receiver device 20 stores the new entry in the local sound library 28 (at block 56). In some aspects, before storing the entry, the device 20 may determine whether or not the local library 28 already includes an entry of the new one that was transmitted by the source device 1. If so, the device 20 may associated at least some of the data of the new entry (e.g., the identifier, the PCM digital audio, the image data, etc.) with the existing entry. In another aspect, the device 20 may instead transmit the existing entry back to the source device 1, for the source device 1 to store the existing entry, rather than the new one.

Some aspects perform variations of the process 50. For example, the specific operations of the process 50 may not be performed in the exact order shown and described. The specific operations may not be performed in one continuous series of operations and different specific operations may be performed in different aspects. In one aspect, upon determining that the local sound library 9 does not include an entry associated with the spatial sound-source data, the audio source device 1 may transmit a request to a remote device to determine whether a remote library associated with the remote device includes a corresponding entry. For instance, the audio source device 1 may transmit a request for a remote server to perform a table lookup into a remote library. As another example, the audio source device 1 may transmit a request to the audio receiver device 20, to determine whether the device 20 already includes a corresponding entry. If so, the remote device may transmit the corresponding entry to the source device 1 for storage in the library 9. In one aspect, when obtaining the entry, the source device 1 may modify a least some of the data in the entry (e.g., position data, loudness data, etc.).

In one aspect, the audio source device may store (at least a portion of) the sound library 9 in a remote storage (e.g., a cloud-based storage). Specifically, the source device may encode (or encrypt) the sound library to prevent other devices from retrieving the library without authorization. In one aspect, the audio source device 1 and/or the audio receiver device 20 may share at least a portion of the remotely stored sound library, while engaged in a communication session with one another. For instance, once engaged, the audio source device 1 may transmit an authorization message to the audio receiver device, authorizing the audio receiver device 20 to retrieve and use the portion of the sound library. In one aspect, the audio source device may determine what portion of the sound library that the audio receiver device may retrieve based on a location of the audio source device. In one aspect, the audio receiver device may perform similar operations.

In one aspect, the audio source device 1 may update and/or build a sound library while not engaged in a communication session with the audio receiver device 20. In this case, the audio source device 1 may perform at least some of the operations described in blocks 51-55, in order to build a library of different sound objects (and sound beds) within an environment in which the user is located. In one aspect, while in this state, the device 1 may perform these operations without user interference or in the background.

In another aspect, sonic descriptors of sound objects and/or sound beds may be transmitted by the audio source device 1 to the audio receiver device 20 for spatial reproduction based on user input at the device 1. Specifically, as described thus far, sonic descriptors may be transmitted based on the bandwidth or available throughput of the communication data link. In one aspect, however, the user may command the device 1 to transmit a sonic descriptor to the receiver device 20 in order for a sound object of the sonic descriptor to be spatially rendered at a given position. For example, both devices may be HMDs that are presenting a CGR environment (e.g., VR and/or MR), by displaying the setting on a respective display screen and outputting sounds of the setting through respective speakers. The user of device 1 may wish for the receiver device to output a sound (e.g., a dog bark 17) from behind an avatar of the user of the receiver device 20. Thus, the user of device 1 may provide user input (e.g., through a virtual keyboard on a display screen of the source device 1, a voice command, etc.) for device 1 to transmit the dog bark 17 to the receiver device 20. In response, the identifier 10 may perform a table lookup into the sound library for a predefined sound object that has matching descriptive data. Once identified, the identifier 10 may produce the sound object sonic descriptor for the dog bark, include any associated metadata (e.g., position data indicated by the user), and transmit the sonic descriptor to the receiver device 20 for spatial rendering.

In one aspect, as described thus far, the sound library may contain metadata and/or audio data associated with sound objects and/or sound beds that are identified within the environment. In some aspects, at least some of the entries within the sound library 9 (and/or 28) may contain image data of the sound object. In one aspect, the image data may be populated by the identifier 10, while updating and/or building the library. In another aspect, the image data may be a part of the sonic descriptors (e.g., 13 and 14), when a new entry is transmitted to an audio receiver device 20. In this way, along with spatially rendering a sound object, image data associated with the sound object may be displayed on the display screen 23. Continuing with the previous example, when both devices are communicating via a CGR environment, the audio source device 1 may want to add a dog bark 17 into the environment. Upon receiving the sonic descriptor of the dog bark, the audio receiver device 20 may retrieve image data associated with the dog bark (e.g., a dog), and present the dog in the environment, at a position within the environment at which the dog bark is to be spatially rendered. In one aspect, any sound object added into the CGR environment may be presented by both the audio source device 1 and the audio receiver device 20.

According to one aspect, a method includes establishing, via a communication data link, a communication session with an audio source device, obtaining, over the communication data link and from the audio source device, a downlink signal associated with the communication session that contains a speech audio signal and a sound-object sonic descriptor having metadata that describes a sound object, using the metadata to produce a reproduction of the sound object comprising an audio signal and position data that indicates a position of a virtual sound source of the sound object, spatially rendering the audio signal according to the position data to produce several binaural audio signals, and mixing the speech audio signal with the binaural audio signals to produce several mixed signals to drive several speakers. In one aspect, the downlink signal includes a phoneme sonic descriptor having phoneme data that textually represents the speech audio signal. In another aspect, the method further includes using the phoneme data to produce a synthesized speech signal, and mixing the synthesized speech signal with the binaural audio signals instead of the speech audio signal to produce several different mixed audio signals to drive the speakers. In some aspects, the synthesized speech signal is different than the speech audio signal by having speech that at least one of has a different voice than speech of the speech audio signal and is a different language than a language of the speech of the speech audio signal.

In one aspect, the metadata has a unique index identifier that identifies the sound object, wherein using the metadata to produce the reproduction of the sound object comprises performing a table lookup into a sound library that has one or more entries for predefined sound objects, each entry having a corresponding unique identifier using the unique index identifier to identify a predefined sound object that has a matching unique index identifier. In some aspects, upon identifying the predefined sound object, the method further includes retrieving the sound object from the sound library that comprises the audio signal that is stored within the sound library. In another aspect, the sound object is a first sound object, the method further includes obtaining, over the communication data link, a new entry for the sound library for a second sound object comprising an audio signal associated with the second sound object and metadata that describes the second sound object, wherein the metadata comprises 1) an index identifier that uniquely identifies the second sound object and 2) position data that indicates a position of the sound object within an acoustic environment, and spatially rendering the second sound object according to the position data to produce a second several binaural audio signals, to drive the speakers. In one aspect, the sound-object sonic descriptor is a first sound-object sonic descriptor, the method further includes obtaining a future portion of the downlink signal that contains an additional portion of the speech audio signal and a second sound-object data sonic descriptor having metadata that describes the second object, wherein the second sound-object sonic descriptor's metadata has 1) the index identifier but does not contain audio signal associated with the second sound object and 2) the position data, using the index identifier to retrieve the second sound object, spatially rendering the second sound object according to the position data to produce a third plurality of binaural signals, and mixing the additional portion of the speech audio signal with the third binaural audio signals produce a second plurality of mixed signals to drive the plurality of speakers.

According to one aspect, a method includes obtaining, from a microphone array of an electronic device, several audio signals, processing the audio signals to identify a sound object, determining whether the sound object is stored within a sound library that contains previously identified sound objects, and in response to determining that the sound object is not stored within the sound library, creating a new entry in the sound library for the sound object that comprises metadata describing the sound object, wherein the metadata includes at least an index identifier that uniquely identifies the sound object. In one aspect, processing the audio signals includes producing an audio signal that is associated with the sound object. In another aspect, the method further includes capturing, using a camera of the electronic device, a scene of an environment in which the electronic device is located as image data, wherein the plurality of audio signals is processed according to the image data. In some aspects, producing the audio signal includes estimating a position of the sound object within the environment by performing an object recognition algorithm upon the image data to identify an object within the scene of the environment that is associated with the sound object; and performing beamforming operations upon the audio signals to adapt a directional beam pattern towards a direction of the object using the estimated position in order to produce an output beamformer signal that contains sound of the sound object.

In one aspect, the electronic device is a first electronic device and the sound library is a first sound library, the method further includes transmitting, to a second electronic device, the new entry of the sound library that contains the sound object having the audio signal and metadata associated with the sound object, where the second electronic device is configured to store the entry in a second sound library and spatially render the sound object for output through several speakers. In some aspects, the method further includes processing a portion of the audio signals to subsequently identify the sound object after a previous identification of the sound object; producing a sound-object sonic descriptor that has metadata describing the sound object, wherein the metadata comprises the index identifier; and transmitting the sound-object sonic descriptor to the second electronic device that is configured to 1) perform a table lookup into the second sound library to identify the sound object using the index identifier, 2) reproduce the sound object that contains the audio signal, and 3) and spatially reproduce the sound object as several audio signals to drive several speakers. In another aspect, the method further includes obtaining user input indicating that the sound object is to be spatially rendered by the second electronic device; in response to the user input, producing a sound-object sonic descriptor that has metadata describing the sound object, wherein the metadata comprises the index identifier; and transmitting the sound-object sonic descriptor to the second electronic device that is configured to 1) perform a table lookup into the second sound library to identify the sound object using the index identifier, 2) reproduce the sound object that contains the audio signal, and 3) and spatially reproduce the sound object as a plurality of audio signals to drive a plurality of speakers.

An aspect of the disclosure may be a non-transitory machine-readable medium (such as microelectronic memory) having stored thereon instructions, which program one or more data processing components (generically referred to here as a "processor") to perform the network operations, signal processing operations, and audio processing operations. In other aspects, some of these operations might be performed by specific hardware components that contain hardwired logic. Those operations might alternatively be performed by any combination of programmed data processing components and fixed hardwired circuit components.

While certain aspects have been described and shown in the accompanying drawings, it is to be understood that such aspects are merely illustrative of and not restrictive on the broad disclosure, and that the disclosure is not limited to the specific constructions and arrangements shown and described, since various other modifications may occur to those of ordinary skill in the art. The description is thus to be regarded as illustrative instead of limiting.

Personal information that is to be used should follow practices and privacy policies that are normally recognized as meeting (and/or exceeding) governmental and/or industry requirements to maintain privacy of users. For instance, any information should be managed so as to reduce risks of unauthorized or unintentional access or use, and the users should be informed clearly of the nature of any authorized use.

In some aspects, this disclosure may include the language, for example, "at least one of [element A] and [element B]." This language may refer to one or more of the elements. For example, "at least one of A and B" may refer to "A," "B," or "A and B." Specifically, "at least one of A and B" may refer to "at least one of A and at least one of B," or "at least of either A or B." In some aspects, this disclosure may include the language, for example, "[element A], [element B], and/or [element C]." This language may refer to either of the elements or any combination thereof. For instance, "A, B, and/or C" may refer to "A," "B," "C," "A and B," "A and C," "B and C," or "A, B, and C."

What is claimed is:

1. A method performed by a first electronic device, the method comprising:

receiving, over a communication data link and from a second electronic device, a speech signal and a sound-object sonic descriptor having metadata that describes a sound object that are associated with a communication session between both devices, wherein the speech signal and the sound-object sonic descriptor are sent based on bandwidth availability of the second electronic device;

using the metadata to produce a reproduction of the sound object comprising an audio signal and position data that indicates a position of a virtual sound source of the sound object;

spatially rendering the audio signal according to the position data to produce a plurality of binaural signals; and mixing the speech signal with the plurality of binaural signals to produce a plurality of mixed signals to drive a plurality of speakers.

2. The method of claim 1 further comprises, in response to a reduction in bandwidth availability of the second electronic device, receiving, over the communication data link and from the second electronic device, a phoneme sonic descriptor having phoneme data that textually represents the speech signal in lieu of the speech signal.

3. The method of claim 2 further comprising:

using the phoneme data to produce a synthesized speech signal; and mixing the synthesized speech signal with the plurality of binaural signals instead of the speech signal to produce a plurality of different mixed signals to drive the plurality of speakers instead of the plurality of mixed signals.

4. The method of claim 1 further comprising displaying an object within a computer generated reality (CGR) environment on a display screen of the first electronic device, wherein the position data indicates the position of the object in the CGR environment such that the audio signal is spatially rendered at that position.

5. The method of claim 1 further comprising:

receiving a phoneme sonic descriptor having phoneme data;

producing a synthesized speech signal using the phoneme data, wherein the synthesized speech signal is different than the speech signal by having speech that has at least one of 1) a different voice than a voice of speech of the speech signal and 2) a different language than a language of the speech of the speech signal; and using the synthesized speech signal to drive one or more speakers of the plurality of speakers.

6. The method of claim 1, wherein the metadata has a unique index identifier that identifies the sound object, wherein using the metadata to produce the reproduction of the sound object comprises:

performing a table lookup into a sound library that has one or more entries for predefined sound objects, each entry having a corresponding unique identifier, using the unique index identifier to identify a predefined sound object that has a matching unique index identifier; and retrieving the identified predefined sound object from the sound library that comprises the audio signal that is stored within the sound library.

7. The method of claim 6, wherein the sound object is a first sound object, wherein the method further comprises:

receiving, over the communication data link, a new entry for the sound library for a second sound object comprising an audio signal associated with the second sound object and metadata that describes the second sound object, wherein the metadata comprises 1) an index identifier that uniquely identifies the second sound object and 2) position data that indicates a position of the sound object within an acoustic environment; and spatially rendering the second sound object according to the position data to produce a second plurality of binaural audio signals, to drive the plurality of speakers.

8. A first electronic device comprising:

at least one processor; and memory having instructions which when executed by the at least one processor causes the first electronic device to receive, over a communication data link and from a second electronic device, a speech signal and a sound-object sonic descriptor having metadata that describes a sound object that are associated with a communication session between both device, wherein the speech signal and the sound-object sonic descriptor are sent based on bandwidth availability of the second electronic device, use the metadata to produce a reproduction of the sound object comprising an audio signal and position data that indicates a position of a virtual sound source of the sound object, spatially render the audio signal according to the position data to produce a plurality of binaural signals, and mix the speech signal with the plurality of binaural signals to produce a plurality of mixed signals to drive a plurality of speakers.

9. The first electronic device of claim 8, wherein the memory has further instructions to, in response to a reduction in bandwidth availability of the second electronic device, receive, over the communication data link and from the second electronic device, a phoneme sonic descriptor having phoneme data that textually represents the speech signal in lieu of the speech signal.

10. The first electronic device of claim 9, wherein the memory has further instructions to:

use the phoneme data to produce a synthesized speech signal; and mix the synthesized speech signal with the plurality of binaural signals instead of the speech signal to produce a plurality of different mixed signals to drive the plurality of speakers instead of the plurality of mixed signals.

11. The first electronic device of claim 8, wherein the memory has further instructions to display an object within a computer generated reality (CGR) environment on a display screen of the first electronic device, wherein the position data indicates the position of the object in the CGR environment such that the audio signal is spatially rendered at that position.

12. The first electronic device of claim 8, wherein the memory has further instructions to:

receive a phoneme sonic descriptor having phoneme data;

produce a synthesized speech signal using the phoneme data, wherein the synthesized speech signal is different than the speech signal by having speech that has at least one of 1) a different voice than a voice of speech of the speech signal and 2) a different language than a language of the speech of the speech signal; and use the synthesized speech signal to drive one or more speakers of the plurality of speakers.

13. The first electronic device of claim 8, wherein the metadata has a unique index identifier that identifies the sound object, wherein the instructions to use the metadata to produce the reproduction of the sound object comprises perform a table lookup into a sound library that has one or more entries for predefined sound objects, each entry having a corresponding unique identifier, using the unique index identifier to identify a predefined sound object that has a matching unique index identifier; and retrieve the identified predefined sound object from the sound library that comprises the audio signal that is stored within the sound library.

14. The first electronic device of claim 13, wherein the sound object is a first sound object, wherein the memory has further instructions to:

receive, over the communication data link, a new entry for the sound library for a second sound object comprising an audio signal associated with the second sound object and metadata that describes the second sound object, wherein the metadata comprises 1) an index identifier that uniquely identifies the second sound object and 2) position data that indicates a position of the sound object within an acoustic environment; and spatially render the second sound object according to the position data to produce a second plurality of binaural audio signals, to drive the plurality of speakers.

15. A method comprising:

obtaining, from a microphone array of an electronic device, a plurality of audio signals;

processing the plurality of audio signals to 1) identify a sound object within an environment in which the electronic device is located and 2) produce an audio signal that is associated with the sound object;

determining whether the sound object is stored within a sound library that contains previously identified sound objects;

in response to determining that the sound object is not stored within the sound library, creating a new entry in the sound library for the sound object that comprises at least one of metadata describing the sound object, which includes at least an index identifier that uniquely identifies the sound object with respect to other entries in the sound library, and the audio signal.

16. The method of claim 15, wherein the audio signal is produced by estimating a position of the sound object within the environment by performing an object recognition algorithm upon image data captured by a camera of the electronic device to identify an object within a scene of the environment that is associated with the sound object; and performing beamforming operations upon the plurality of audio signals to adapt a directional beam pattern towards a direction of the object using the estimated position in order to produce an output beamformer signal that contains sound of the sound object.

17. The method of claim 15, wherein the electronic device is a first electronic device and the sound library is a first sound library, wherein the method further comprises transmitting, over a communication data link to a second electronic device, the new entry of the sound library that contains the sound object having the audio signal and metadata associated with the sound object to be stored in a second sound library of the second electronic device.

18. The method of claim 15 further comprising:

processing a portion of the plurality of audio signals to subsequently identify the sound object after a previous identification of the sound object;

producing a sound-object sonic descriptor that has metadata describing the sound object, wherein the metadata comprises the index identifier;

determining bandwidth availability for transmitting data to a second electronic device; and transmitting the sound-object sonic descriptor to the second electronic device that is configured based on the bandwidth availability.

19. The method of claim 18 further comprising:

determining whether the bandwidth availability is less than a threshold; and in response to the bandwidth availability being less than the threshold, preventing transmission of future sound-object sonic descriptors.

20. The method of claim 15 further comprising:

obtaining user input indicating that the sound object is to be spatially rendered by second electronic device at a particular position;

in response to the user input, producing a sound-object sonic descriptor that has metadata describing the sound object, wherein the metadata comprises the index identifier and position data that describes the particular position at which the sound object is to be spatially rendered; and transmitting the sound-object sonic descriptor to second electronic device.

* * * * *